US010363738B2

(12) United States Patent
Shinkawa

(10) Patent No.: US 10,363,738 B2
(45) Date of Patent: Jul. 30, 2019

(54) LIQUID EJECTING DEVICE, HEAD UNIT, AND METHOD FOR CONTROLLING LIQUID EJECTING DEVICE

(71) Applicant: Seiko Epson Corporation, Tokyo (JP)

(72) Inventor: Osamu Shinkawa, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/755,946

(22) PCT Filed: Aug. 23, 2016

(86) PCT No.: PCT/JP2016/003826
§ 371 (c)(1),
(2) Date: Feb. 27, 2018

(87) PCT Pub. No.: WO2017/038046
PCT Pub. Date: Mar. 9, 2017

(65) Prior Publication Data

US 2018/0257371 A1 Sep. 13, 2018

(30) Foreign Application Priority Data

Aug. 31, 2015 (JP) ..... 2015-169924

(51) Int. Cl.
*B41J 29/38* (2006.01)
*B41J 2/045* (2006.01)
(Continued)

(52) U.S. Cl.
CPC ..... *B41J 2/04588* (2013.01); *B41J 2/0451* (2013.01); *B41J 2/04541* (2013.01);
(Continued)

(58) Field of Classification Search
USPC ..... 347/19
See application file for complete search history.

(56) References Cited

U.S. PATENT DOCUMENTS 7,150,513 B2 12/2006 Shinkawa et al.
2003/0067500 A1 4/2003 Fujimura et al.
(Continued)

FOREIGN PATENT DOCUMENTS

CN 103029438 A 4/2013
JP 2004-276544 A 10/2004
JP 2015-110291 A 6/2015

*Primary Examiner* — Lam S Nguyen
(74) *Attorney, Agent, or Firm* — Harness, Dickey & Pierce, P.L.C.

(57) ABSTRACT

A liquid ejecting device includes: an ejector including: a piezoelectric element displacing corresponding to a drive signal potential; a pressure chamber changing volume corresponding to the piezoelectric element displacement; and a nozzle communicating with the pressure chamber, and ejecting liquid from the pressure chamber; and a detector detecting residual vibrations produced by the ejector after piezoelectric element displacement. The detector detects the residual vibrations in a third period when the drive signal having a drive waveform is supplied to the piezoelectric element. The drive waveform being set to a first potential in a first period, a second potential in a second period, and a third potential in the third period. The volume of the pressure chamber in the second period is smaller than the volume in the first period. The volume of the pressure chamber in the third period is larger than in the second period.

8 Claims, 15 Drawing Sheets

(51) Int. Cl.

| | |
|---|---|
| ***B41J 29/393*** | (2006.01) |
| ***B41J 2/165*** | (2006.01) |
| ***B41J 2/14*** | (2006.01) |

(52) U.S. Cl.

CPC ..... *B41J 2/04581* (2013.01); *B41J 2/04593* (2013.01); *B41J 2/04596* (2013.01); *B41J 2/14201* (2013.01); *B41J 2/16579* (2013.01); *B41J 2/16585* (2013.01); *B41J 29/38* (2013.01); *B41J 29/393* (2013.01); *B41J 2002/14354* (2013.01); *B41J 2202/21* (2013.01)

(56) References Cited

U.S. PATENT DOCUMENTS

| | | | | |
|---|---|---|---|---|
| 2003/0179254 | A1 | 9/2003 | Okuda | |
| 2005/0212845 | A1* | 9/2005 | Shinkawa | B41J 2/0451 347/19 |
| 2006/0071964 | A1 | 4/2006 | Oku | |
| 2008/0211847 | A1* | 9/2008 | Shamoun | B41J 2/04541 347/10 |
| 2012/0249638 | A1* | 10/2012 | Takano | B41J 2/0454 347/10 |
| 2012/0320120 | A1 | 12/2012 | Suzuki et al. | |
| 2013/0083107 | A1 | 4/2013 | Nishikawa et al. | |
| 2014/0125722 | A1 | 5/2014 | Otokita | |
| 2015/0054876 | A1 | 2/2015 | Nakazawa et al. | |
| 2015/0158293 | A1 | 6/2015 | Suzuki et al. | |

* cited by examiner

| | SI[m] (b1, b2) | Ts1 | | Ts2 | |
|---|---|---|---|---|---|
| | | Sa[m] | Sb[m] | Sa[m] | Sb[m] |
| LARGE DOT | (1, 1) | H | L | H | L |
| MEDIUM DOT | (1, 0) | H | L | L | H |
| SMALL DOT | (0, 1) | L | H | H | L |
| NON-RECORDING | (0, 0) | L | H | L | H |

LIQUID EJECTING DEVICE, HEAD UNIT, AND METHOD FOR CONTROLLING LIQUID EJECTING DEVICE

BACKGROUND

Technical Field

The present invention relates to a liquid ejecting device, a head unit, and a method for controlling a liquid ejecting device.

Related Art

A liquid ejecting device such as an inkjet printer is configured so that a liquid (e.g., ink) with which a cavity (pressure chamber) formed in an ejecting section is filled, is ejected by driving (displacing) a piezoelectric element provided to the ejecting section based on a drive signal to form an image on a recording medium. Such a liquid ejecting device has a problem in that an abnormal ejection state (in which the liquid cannot be normally ejected from the ejecting section) may occur when the liquid within the cavity has increased in viscosity, or when air bubbles have been formed within the cavity, for example. When such an abnormal ejection state has occurred, it may be impossible to accurately form a predetermined dot on the recording medium using the liquid ejected from the ejecting section, whereby the quality of the image that is formed by the liquid ejecting device on the recording medium may deteriorate.

JP-2004-276544 discloses technology that prevents deterioration in image quality due to an abnormal ejection state by detecting residual vibrations produced by the ejecting section after driving (displacing) the piezoelectric element based on the drive signal, and determining the liquid ejection state of the ejecting section based on the properties (e.g., cycle and amplitude) of the residual vibrations.

In recent years, the cycle of the drive signal has decreased along with an increase in the printing speed, and the piezoelectric element has been driven based on the drive signal at reduced intervals. When the cycle of the drive signal is reduced, a detection period that is provided to detect residual vibrations (i.e., a period in which the signal level of the drive signal is maintained at a constant level, or a change in the signal level of the drive signal is reduced in order to accurately detect residual vibrations) is also reduced. When the detection period is short, it is likely that it is difficult to accurately determine the characteristics (e.g., cycle and amplitude) of residual vibrations. In this case, it is likely that the determination accuracy as to the ejection state based on the characteristics of residual vibrations, deteriorates.

The invention was conceived in view of the above situation. An object of the invention is to provide technology that makes it possible to accurately determine the characteristics of residual vibrations even when it is difficult to provide a sufficient residual vibration detection period.

SUMMARY

According to one aspect of the invention, there is provided a liquid ejecting device including:

an ejecting section that includes a piezoelectric element that is displaced corresponding to a change in potential of a drive signal, a pressure chamber that changes in internal volume corresponding to the displacement of the piezoelectric element, and a nozzle that communicates with the pressure chamber, and can eject a liquid contained in the pressure chamber corresponding to a change in the internal volume of the pressure chamber; and a detection section that can detect residual vibrations produced by the ejecting section after the piezoelectric element has been displaced, the detection section detecting the residual vibrations produced by the ejecting section in a third period when the drive signal having a drive waveform is supplied to the piezoelectric element, the drive waveform being set to a first potential in a first period, set to a second potential in a second period that follows the first period, and set to a third potential in the third period that follows the second period, the internal volume of the pressure chamber in the second period being smaller than the internal volume of the pressure chamber in the first period, and the internal volume of the pressure chamber in the third period being larger than the internal volume of the pressure chamber in the second period.

According to the liquid ejecting device, composite vibrations of the residual vibrations produced by the ejecting section due to a waveform that changes from a potential differing from the first potential to the first potential before the first period starts (hereinafter referred to as "first waveform"), the residual vibrations produced by the ejecting section due to a waveform that changes from a potential differing from the second potential to the second potential before the second period starts (hereinafter referred to as "second waveform"), and the residual vibrations produced by the ejecting section due to a waveform that changes from a potential differing from the third potential to the third potential before the third period starts (hereinafter referred to as "third waveform"), can be detected in the third period. Therefore, a larger amount of information can be acquired from the residual vibration detection result as compared with the case where the residual vibrations produced by the ejecting section due to the first waveform are detected in the first period, or the case where composite vibrations of the residual vibrations produced by the ejecting section due to the first waveform and the residual vibrations produced by the ejecting section due to the second waveform are detected in the second period, for example. Specifically, it is possible to accurately determine the characteristics of the residual vibrations by detecting the residual vibrations in the third period instead of detecting the residual vibrations in the first period or the second period. This makes it possible to accurately determine the characteristics of the residual vibrations even when it is difficult to provide a sufficient residual vibration detection period, and accurately determine the ejection state of the liquid from the ejecting section.

In the liquid ejecting device, the detection section may detect either or both of the residual vibrations produced by the ejecting section in the first period and the residual vibrations produced by the ejecting section in the second period.

According to this configuration, the residual vibrations are detected in at least one of the first period and the second period in addition to the third period. Specifically, the residual vibrations are detected in at least two periods including the third period. Therefore, the time length in which the residual vibrations are detected can be increased as compared with the case of detecting the residual vibrations only in one period, and a larger amount of information can be acquired from the residual vibration detection result. This makes it possible to accurately determine the characteristics of the residual vibrations even when the time length of each of the first period, the second period, and the third period is short, and accurately determine the ejection state of the liquid from the ejecting section.

In the liquid ejecting device, the drive waveform may be designed so that a potential at a first time that precedes the first period is the third potential, and a potential at a second time that follows the third period is the third potential.

According to this configuration, since the residual vibrations due to the first waveform can be produced in the first period, a larger amount of information can be acquired from the residual vibration detection result in the third period as compared with the case where the residual vibrations due to the first waveform are not produced. This makes it possible to accurately determine the characteristics of the residual vibrations, and accurately determine the ejection state of the liquid from the ejecting section.

In the liquid ejecting device, the drive waveform may be designed so that the difference between the third potential and the first potential is larger than the difference between the second potential and the third potential.

According to this configuration, the amplitude of the residual vibrations produced due to the third waveform can be reduced as compared with the amplitude of the residual vibrations produced due to the first waveform. Therefore, the amplitude of the residual vibrations produced by the ejecting section in a period that follows the third period can be reduced as compared with the case where the amplitude of the residual vibrations produced due to the third waveform is larger than the amplitude of the residual vibrations produced due to the first waveform. This makes it possible to reduce the possibility that the residual vibrations produced by the ejecting section in a period that precedes the third period affect (as noise) the printing process that is performed in a period that follows the third period, or the ejection state determination process that is performed in a period that follows the third period.

In the liquid ejecting device, at least one period among the first period, the second period, and the third period may be shorter than the cycle of the residual vibrations produced by the ejecting section when the ejection state of the liquid from the ejecting section is normal.

According to this configuration, since the first period, the second period, and the third period are reduced in time length, it is possible to implement a high-speed printing process, and reduce the time required for the ejection state determination process.

The liquid ejecting device may further include a determination section that determines the ejection state of the liquid from the ejecting section corresponding to the detection result of the detection section.

According to this configuration, since the ejection state of the liquid from the ejecting section can be determined based on the residual vibration detection result, it is possible to prevent a situation in which the image quality deteriorates due to abnormal ejection of the liquid from the ejecting section.

In the liquid ejecting device, the ejecting section may eject the liquid contained in the pressure chamber through the nozzle in the second period.

According to this configuration, the printing process that ejects the liquid from the ejecting section to form an image on a recording medium, and the ejection state determination process that determines the ejection state of the liquid from the ejecting section, can be performed in parallel. This makes it possible to improve convenience as compared with the case where the printing process is suspended when the ejection state determination process is performed. Since the ejection state determination process is performed during the printing process, it is possible to promptly detect an abnormal ejection state even when an abnormal ejection state has occurred during the printing process. This makes it possible to reduce the possibility that the image quality deteriorates due to an abnormal ejection state.

According to another aspect of the invention, there is provided a head unit that is provided to a liquid ejecting device, the head unit including:

an ejecting section that includes a piezoelectric element that is displaced corresponding to a change in potential of a drive signal, a pressure chamber that changes in internal volume corresponding to the displacement of the piezoelectric element, and a nozzle that communicates with the pressure chamber, and can eject a liquid contained in the pressure chamber corresponding to a change in the internal volume of the pressure chamber; and a detection section that can detect residual vibrations produced by the ejecting section after the piezoelectric element has been displaced, the detection section detecting the residual vibrations produced by the ejecting section in a third period when the drive signal having a drive waveform is supplied to the piezoelectric element, the drive waveform being set to a first potential in a first period, set to a second potential in a second period that follows the first period, and set to a third potential in the third period that follows the second period, the internal volume of the pressure chamber in the second period being smaller than the internal volume of the pressure chamber in the first period, and the internal volume of the pressure chamber in the third period being larger than the internal volume of the pressure chamber in the second period.

According to the head unit, composite vibrations of the residual vibrations produced due to the first waveform that changes to the first potential before the first period starts, the residual vibrations produced due to the second waveform that changes to the second potential before the second period starts, and the residual vibrations produced due to the third waveform that changes to the third potential before the third period starts, can be detected in the third period. Specifically, a larger amount of information can be acquired from the residual vibration detection result by detecting the residual vibrations in the third period instead of detecting the residual vibrations in the first period or the second period, and it is possible to accurately determine the characteristics of the residual vibrations. This makes it possible to accurately determine the ejection state of the liquid from the ejecting section even when it is difficult to provide a sufficient residual vibration detection period.

According to a further aspect of the invention, there is provided a method for controlling a liquid ejecting device that includes an ejecting section that includes:

a piezoelectric element that is displaced corresponding to a change in potential of a drive signal;

a pressure chamber that changes in internal volume corresponding to the displacement of the piezoelectric element; and a nozzle that communicates with the pressure chamber, and can eject a liquid contained in the pressure chamber corresponding to a change in the internal volume of the pressure chamber, the method including:

supplying the drive signal having a drive waveform to the piezoelectric element, the drive waveform being set to a first potential in a first period, set to a second potential in a second period that follows the first period, and set to a third potential in a third period that follows the second period; and detecting residual vibrations produced by the ejecting section in the third period, the internal volume of the pressure chamber in the second period being smaller than the internal volume of the pressure chamber in the first period, and the internal volume of the pressure chamber in the third period being larger than the internal volume of the pressure chamber in the second period.

According to the method for controlling a liquid ejecting device, composite vibrations of the residual vibrations produced due to the first waveform that changes to the first potential before the first period starts, the residual vibrations produced due to the second waveform that changes to the second potential before the second period starts, and the residual vibrations produced due to the third waveform that changes to the third potential before the third period starts, can be detected in the third period. Specifically, a larger amount of information can be acquired from the residual vibration detection result by detecting the residual vibrations in the third period instead of detecting the residual vibrations in the first period or the second period, and it is possible to accurately determine the characteristics of the residual vibrations. This makes it possible to accurately determine the ejection state of the liquid from the ejecting section even when it is difficult to provide a sufficient residual vibration detection period.

DETAILED DESCRIPTION

Figure 1:
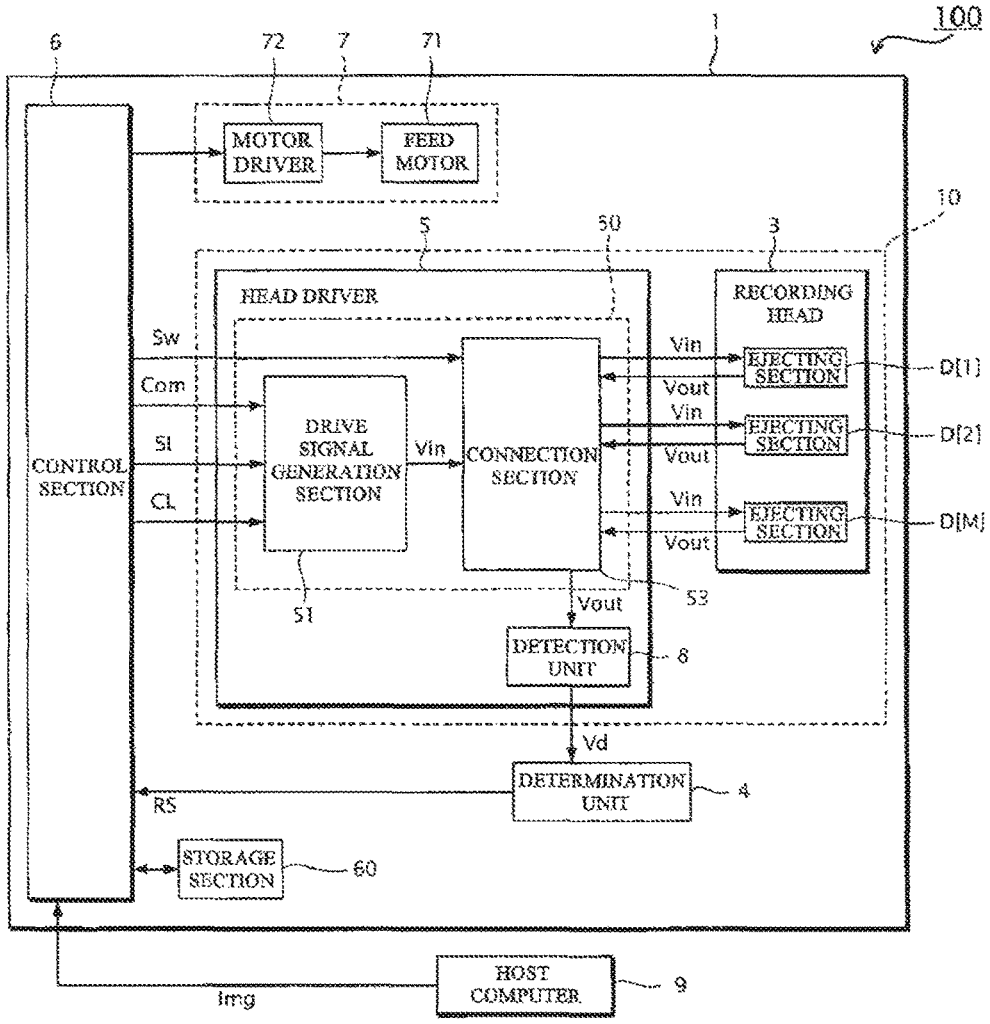
FIG. 1 is a block diagram illustrating the configuration of a printing system 100 according to one embodiment of the invention.

The exemplary embodiments of the invention are described below with reference to the drawings. Note that the dimensional relationship (e.g., scale) between each section (e.g., element) and the like illustrated in the drawings do not necessarily coincide with the actual dimensional relationship and the like. Since the following exemplary embodiments are specific preferred embodiments of the invention, various technically preferred limitations are described in connection with the exemplary embodiments. Note that the scope of the invention is not limited to the following exemplary embodiments unless there is a description that expressly limits the scope of the invention.

A. Embodiments

A liquid ejecting device is described below taking an example in which the liquid ejecting device is an inkjet printer that forms an image on recording paper P (i.e., medium") by ejecting an ink (i.e., liquid) toward the recording paper P.

1. Outline of Printing System

The configuration of an inkjet printer 1 according to one embodiment of the invention is described below with reference to FIGS. 1 and 2.

FIG. 1 is a functional block diagram illustrating the configuration of a printing system 100 that includes the inkjet printer 1. The printing system 100 includes a host computer 9 (e.g., personal computer or digital camera), and the inkjet printer 1.

The host computer 9 outputs print data Img that represents an image to be formed by the inkjet printer 1, and information that represents the number of copies of the image to be formed by the inkjet printer 1.

The inkjet printer 1 performs a printing process that forms the image represented by the print data Img supplied from the host computer 9 on the recording paper P in the desired number of copies. Note that an example in which the inkjet printer 1 is a line printer is described below.

As illustrated in FIG. 1, the inkjet printer 1 includes a head unit 10 that includes an ejecting section D that ejects an ink, a determination unit 4 (i.e., determination section) that determines the ejection state of the ink from the ejecting section D, a feed mechanism 7 that changes the relative position of the recording paper P with respect to the head unit 10, a control section 6 that controls the operation of each section of the inkjet printer 1, a storage section 60 that stores a control program that controls the inkjet printer 1, and other pieces of information, a maintenance mechanism (not illustrated in FIG. 1) that performs a maintenance process that returns the ejection state of the ink from the ejecting section D to a normal state when it has been detected that an abnormal ejection state has occurred in the ejecting section D, and a display-operation section (not illustrated in FIG. 1) that includes a display section that is implemented by a liquid crystal display, an LED lamp, or the like, and displays an error message and the like, and an operation section that allows the user of the inkjet printer 1 to input various commands and the like to the inkjet printer 1.

Note that the inkjet printer 1 according to one embodiment of the invention includes a plurality of head units 10 and a plurality of determination units 4 (as described in detail later).

Figure 2:
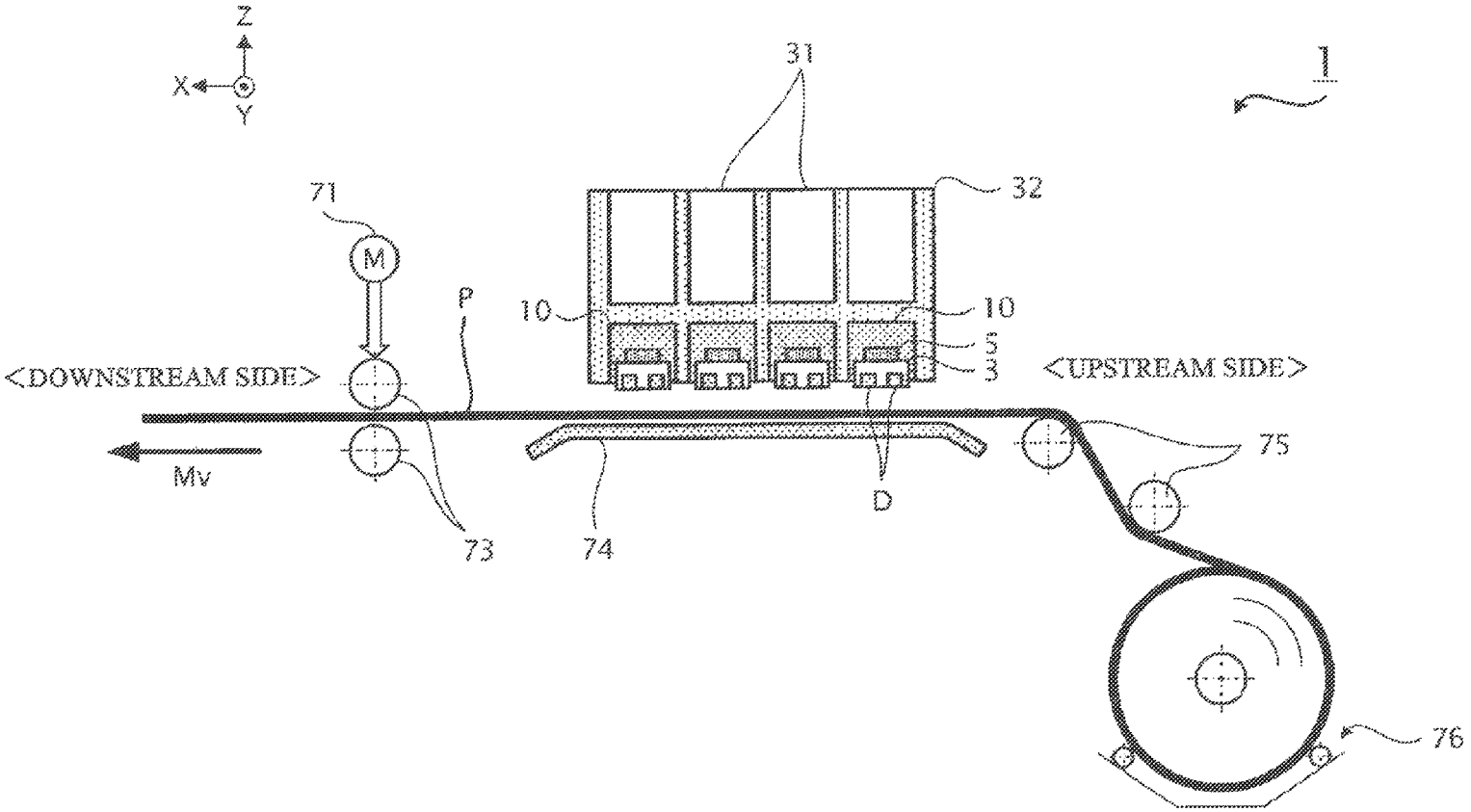
FIG. 2 is a schematic partial cross-sectional view illustrating an inkjet printer 1.

FIG. 2 is a partial cross-sectional view schematically illustrating the internal configuration of the inkjet printer 1.

As illustrated in FIG. 2, the inkjet printer 1 includes a mounting mechanism 32 on which the head unit 10 is mounted. Four ink cartridges 31 are mounted on the mounting mechanism 32 in addition to the head unit 10. The four ink cartridges 31 are provided corresponding to four colors (CMYK) (i.e., black, cyan, magenta, and yellow) on a one-to-one basis. Each ink cartridge 31 is filled with an ink having the color that corresponds to the ink cartridge 31. Note that each ink cartridge 31 may not be mounted on the mounting mechanism 32, and may be provided to another part of the inkjet printer 1.

As illustrated in FIG. 2, the inkjet printer 1 includes four head units 10 that correspond to the four ink cartridges 31 on a one-to-one basis. The inkjet printer 1 includes four determination units 4 that correspond to the four ink cartridges 31 on a one-to-one basis.

Note that the following description with regard to the head unit 10 and the determination unit 4 focuses on one head unit 10 and one determination unit 4 that are provided corresponding to an arbitrary ink cartridge 31 among the four ink cartridges 31, but is also applied to the remaining three head units 10 and the remaining three determination units 4.

As illustrated in FIG. 1, the feed mechanism 7 includes a feed motor 71 that serves as a drive source for feeding the recording paper P, and a motor driver 72 that drives the feed motor 71. As illustrated in FIG. 2, the feed mechanism 7 includes a platen 74 that is provided under the mounting mechanism 32 (i.e., provided in the −Z-direction with respect to the mounting mechanism 32 in FIG. 2), a feed roller 73 that is rotated by the feed motor 71, a guide roller 75 that is provided so as to be rotatable around the Y-axis (see FIG. 2), and a holding section 76 that holds the recording paper P in a wound state. When the inkjet printer 1 performs the printing process, the feed mechanism 7 feeds the recording paper P held by the holding section 76 in the +X-direction (see FIG. 2) (i.e., the direction from the upstream side to the downstream side) at a feed rate My along a transfer path defined by the guide roller 75, the platen 74, and the feed roller 73.

The storage section 60 includes an electrically erasable programmable read-only memory (EEPROM) (i.e., nonvolatile semiconductor memory) that stores the print data Img supplied from the host computer 9, a random access memory (RAM) which temporarily stores data necessary when performing various processes (e.g., printing process), and into which the control program for performing various processes (e.g., printing process) is temporarily loaded, and a PROM (i.e., nonvolatile semiconductor memory) that stores the control program for controlling each section of the inkjet printer 1.

The control section 6 includes a central processing unit (CPU), a field-programmable gate array (FPGA), and the like, and the CPU and the like operate according to the control program stored in the storage section 60 to control the operation of each section of the inkjet printer 1.

The control section 6 controls the head unit 10 and the feed mechanism 7 based on the print data Img and the like supplied from the host computer 9 to control the printing process that forms the image that corresponds to the print data Img on the recording paper P.

More specifically, the control section 6 stores the print data Img supplied from the host computer 9 in the storage section 60.

The control section 6 generates a print signal SI, a drive waveform signal Com, and the like that control the operation of the head unit 10 and drive the ejecting section D based on various types of data (e.g., print data Img) stored in the storage section 60.

The control section 6 generates various signals that control the operation of the motor driver 72 based on the print signal SI and various types of data stored in the storage section 60, and outputs the generated signals. Note that the drive waveform signal Com includes a drive waveform signal Com-A and a drive waveform signal Com-B (as described in detail later).

The drive waveform signal Com is an analog signal. The control section 6 includes a DA conversion circuit (not illustrated in the drawings). The control section 6 converts a digital drive waveform signal generated by the CPU and the like included in the control section 6 into the analog drive waveform signal Com, and outputs the analog drive waveform signal Com.

The control section 6 drives the feed motor 71 so as to feed the recording paper P in the +X-direction by controlling the motor driver 72, and controls the ejection of the ink from the ejecting section D, the ejection volume of the ink, the ejection timing of the ink, and the like by controlling the head unit 10. The control section 6 thus controls the printing process that adjusts the size and the position of the dot formed by the ink ejected toward the recording paper P, and forms the image corresponding to the print data Img on the recording paper P.

The control section 6 also controls an ejection state determination process that determines whether or not the ejection state of the ink from each ejecting section D is normal (i.e., whether or not an abnormal ejection state has occurred in each ejecting section D) (as described in detail later).

Note that the term "abnormal ejection state" used herein refers to a state in which the ejection state of the ink from the ejecting section D is abnormal (i.e., a state in which the ink cannot be normally (accurately) ejected from a nozzle N (see FIGS. 3 and 4) included in the ejecting section D). More specifically, the term "abnormal ejection state" used herein includes a state in which the ejecting section D cannot eject the ink, a state in which the ejecting section D cannot eject the ink in an amount sufficient to form the image represented by the print data Img (i.e., the ejection volume of the ink is too small), a state in which the ejecting section D ejects the ink in an amount larger than the amount necessary for forming the image represented by the print data Img, a state in which the ink ejected from the ejecting section D is placed at a position that differs from the predetermined placement position for forming the image represented by the print data Img, and the like.

When an abnormal ejection state has occurred in the ejecting section D, the ejection state of the ink from the ejecting section D is returned to a normal state through the maintenance process performed by the maintenance mechanism. The term "maintenance process" used herein refers to a process that returns the ejection state of the ink from the ejecting section D to a normal state by discharging the ink from the ejecting section D (e.g., through a flushing process that causes the ejecting section D to preliminarily eject the ink, or a pumping process that sucks the ink that has increased in viscosity, air bubbles, and the like from the ejecting section D using a tube pump (not illustrated in the drawings)), and supplying the ink to the ejecting section D from the ink cartridge 31.

As illustrated in FIG. 1, each head unit 10 includes a recording head 3 that includes M ejecting sections D (where, M is a natural number that satisfies 1≤M), and a head driver 5 that drives each ejecting section D included in the recording head 3. Note that the M ejecting sections D may be referred to as a first-stage ejecting section D, a second-stage ejecting section D, . . . , and an Mth-stage ejecting section D for convenience of explanation. The mth-stage ejecting section D (where, the variable m is a natural number that satisfies 1≤m≤M) may be referred to as "ejecting section D[m]".

Each of the M ejecting sections D receives the ink from the ink cartridge 31 that corresponds to the head unit 10 that includes the M ejecting sections D. Each ejecting section D is filled with the ink supplied from the ink cartridge 31, and ejects the ink from the nozzle N included in the ejecting section D. Specifically, each ejecting section D ejects the ink toward the recording paper P at a timing at which the feed mechanism 7 feeds the recording paper P over the platen 74 to form a dot that forms the image on the recording paper P. The CMYK inks are ejected from the (4*M) ejecting sections D provided to the four head units 10 to implement full-color printing.

As illustrated in FIG. 1, the head driver 5 includes a drive signal supply section 50 (i.e., supply section) that supplies a drive signal Vin that drives each of the M ejecting sections D included in the recording head 3 to each ejecting section D, and a detection unit 8 (i.e., detection section) that detects residual vibrations produced by the ejecting section D after the ejecting section D has been driven based on the drive signal Vin.

Note that the ejecting section D among the M ejecting sections D for which residual vibrations are detected by the detection unit 8 may be referred to as "target ejecting section Dtg". The control section 6 designates the target ejecting section Dtg from the M ejecting sections D (as described in detail later).

The drive signal supply section 50 includes a drive signal generation section 51 and a connection section 53.

The drive signal generation section 51 generates the drive signal Vin that drives each of the M ejecting sections D included in the recording head 3 based on the signals (e.g., print signal SI, clock signal CL, and drive waveform signal Com) supplied from the control section 6.

The connection section 53 electrically connects each ejecting section D to the drive signal generation section 51 or the detection unit 8 based on a connection control signal Sw supplied from the control section 6. The drive signal Vin generated by the drive signal generation section 51 is supplied to the ejecting section D through the connection section 53. Each ejecting section D is driven based on the drive signal Vin supplied through the connection section 53, and ejects the ink toward the recording paper P.

The detection unit 8 detects a residual vibration signal Vout that represents residual vibrations produced by the ejecting section D designated as the target ejecting section Dtg after the ejecting section D has been driven based on the drive signal Vin. The detection unit 8 performs a noise component removal process, a signal level amplification process, and the like on the detected residual vibration signal Vout to generate a shaped waveform signal Vd, and outputs the generated shaped waveform signal Vd. Note that the drive signal supply section 50 and the detection unit 8 are implemented by an electronic circuit provided on a substrate included in the head unit 10, for example.

The determination unit 4 determines the ejection state of the ink from the ejecting section D designated as the target ejecting section Dtg (during the ejection state determination process) based on the shaped waveform signal Vd output from the detection unit 8, and generates determination information RS that represents the determination result. Note that the determination unit 4 is implemented by an electronic circuit provided on a substrate that is not included in the head unit 10, for example.

The term "ejection state determination process" used herein refers to a process that is performed by the inkjet printer 1. Specifically, the ejection state determination process causes the drive signal supply section 50 to drive the ejecting section D designated as the target ejecting section Dtg under control of the control section 6, causes the detection unit 8 to detect residual vibrations produced by the ejecting section D, and causes the determination unit 4 to generate the determination information RS based on the shaped waveform signal Vd output from the detection unit 8 that has detected residual vibrations, and reference information STth output from the control section 6.

Note that the suffix "[m]" that represents the stage number m may be attached to a sign that represents an element or information that corresponds to the stage number m. For example, the determination information RS that represents the ejection state of the ink from the ejecting section D[m] may be referred to as "determination information RS[m]", and the drive signal Vin supplied to the ejecting section D[m] may be referred to as "drive signal Vin[m]".

2. Configuration of Recording Head

The recording head 3 and the ejecting section D provided to the recording head 3 are described below with reference to FIGS. 3 and 4.

Figure 3:
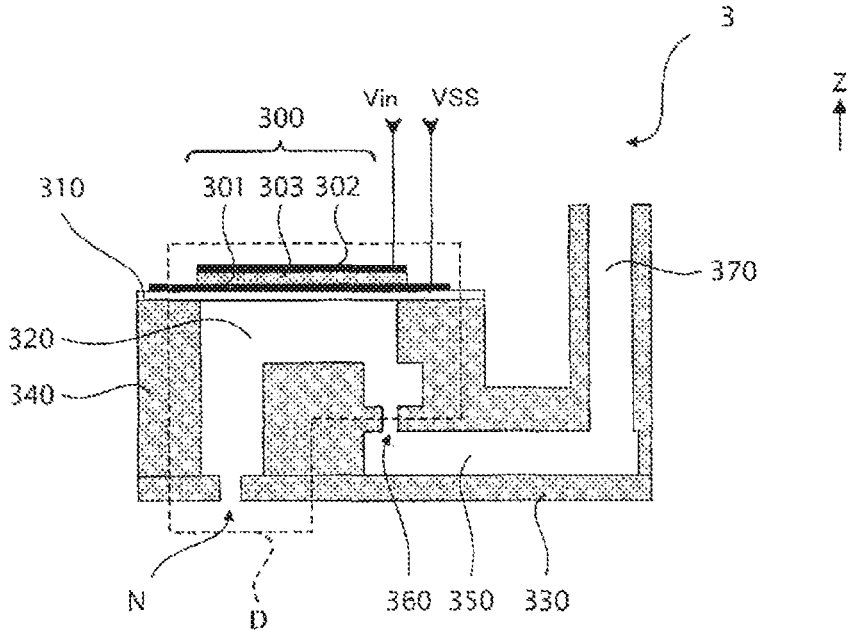
FIG. 3 is a schematic cross-sectional view illustrating a recording head 3.

FIG. 3 illustrates an example of a schematic partial cross-sectional view of the recording head 3. Note that FIG. 3 illustrates one ejecting section D among the M ejecting sections D included in the recording head 3, a reservoir 350 that communicates with the one ejecting section D through an ink inlet 360, and an ink inlet 370 through which the ink is supplied from the ink cartridge 31 to the reservoir 350.

As illustrated in FIG. 3, the ejecting section D includes a piezoelectric element 300, a cavity 320 (i.e., pressure chamber) that is filled with the ink, the nozzle N that communicates with the cavity 320, and a diaphragm 310. The ejecting section D is configured so that the piezoelectric element 300 is driven based on the drive signal Vin to eject the ink contained in the cavity 320 through the nozzle N. The cavity 320 included in the ejecting section D is a space defined by a cavity plate 340 that is formed to have a predetermined shape having a recess, a nozzle plate 330 in which the nozzle N is formed, and the diaphragm 310. The cavity 320 communicates with the reservoir 350 through the ink inlet 360. The reservoir 350 communicates with the ink cartridge 31 through the ink inlet 370.

A unimorph (monomorph)-type piezoelectric element (see FIG. 3) is used as the piezoelectric element 300, for example. Note that the piezoelectric element 300 is not limited to a unimorph-type piezoelectric element. A bimorph-type piezoelectric element, a stacked-type piezoelectric element, or the like may also be used as the piezoelectric element 300.

The piezoelectric element 300 includes a lower electrode 301, an upper electrode 302, and a piezoelectric material 303 provided between the lower electrode 301 and the upper electrode 302. When the lower electrode 301 has been set to a predetermined potential VSS, and the drive signal Vin has been supplied to the upper electrode 302 (i.e., when a voltage has been applied between the lower electrode 301 and the upper electrode 302), the piezoelectric element 300 is warped (displaced) in the upward-downward direction in FIG. 3 corresponding to the applied voltage (i.e., the piezoelectric element 300 vibrates).

The diaphragm 310 is provided to the upper opening of the cavity plate 340, and the lower electrode 301 is bonded to the diaphragm 310. Therefore, when the piezoelectric element 300 vibrates based on the drive signal Vin, the diaphragm 310 also vibrates. The volume of the cavity 320 (i.e., the pressure inside the cavity 320) changes due to the vibration of the diaphragm 310, and the ink with which the cavity 320 is filled is ejected through the nozzle N. When the amount of ink in the cavity 320 has decreased due to ejection, the ink is supplied to the cavity 320 from the reservoir 350. The ink is supplied to the reservoir 350 from the ink cartridge 31 through the ink inlet 370.

Figure 4:
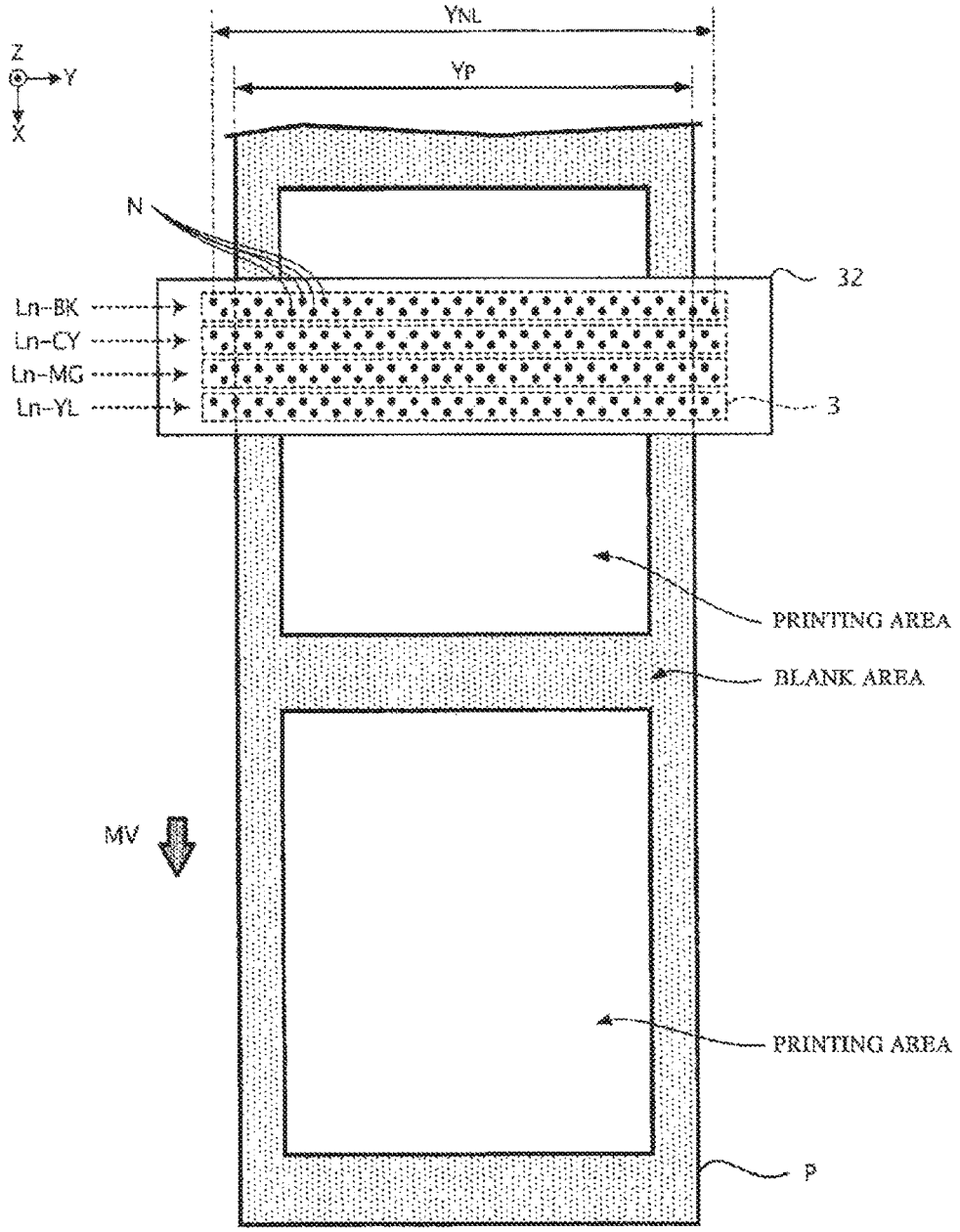
FIG. 4 is a plan view illustrating an example of the arrangement of nozzles N in a recording head 3.

FIG. 4 illustrates an example of the arrangement of M nozzles N provided to each of the four recording heads 3 mounted on the mounting mechanism 32 when the inkjet printer 1 is viewed in the +Z-direction or the −Z-direction (hereinafter may be collectively referred to as "Z-axis direction").

As illustrated in FIG. 4, a nozzle row Ln that consists of M nozzles N is provided to each recording head 3. Specifically, the inkjet printer 1 includes four nozzle rows Ln. More specifically, the inkjet printer 1 includes four nozzle rows Ln including a nozzle row Ln-BK, a nozzle row Ln-CY, a nozzle row Ln-MG, and a nozzle row Ln-YL. Each of a plurality of nozzles N that belong to the nozzle row Ln-BK is the nozzle N provided to the ejecting section D that ejects the black ink, each of a plurality of nozzles N that belong to the nozzle row Ln-CY is the nozzle N provided to the ejecting section D that ejects the cyan ink, each of a plurality of nozzles N that belong to the nozzle row Ln-MG is the nozzle N provided to the ejecting section D that ejects the magenta ink, and each of a plurality of nozzles N that belong to the nozzle row Ln-YL is the nozzle N provided to the ejecting section D that ejects the yellow ink. Each of the four nozzle rows Ln is provided to extend in the +Y-direction or the −Y-direction (hereinafter may be collectively referred to as "Y-axis direction") in a plan view. A range YNL in which each nozzle row Ln extends in the Y-axis direction is equal to or larger than a range YP of the recording paper P in the Y-axis direction when an image is printed on the recording paper P (i.e., the maximum width of the recording paper P in the Y-axis direction in which an image can be printed by the inkjet printer 1).

As illustrated in FIG. 4, a plurality of nozzles N that belong to each nozzle row Ln are disposed in a staggered arrangement so that the even-numbered nozzles N and the odd-numbered nozzles N in the −Y-direction differ in position in the X-axis direction. Note that the arrangement of the nozzles N illustrated in FIG. 4 is merely an example. Each nozzle row Ln may extend in a direction that differs from the Y-axis direction, and a plurality of nozzles N that belong to each nozzle row Ln may be disposed linearly.

Note that the printing process according to one embodiment of the invention divides the recording paper P into a plurality of printing areas (e.g., rectangular areas having the A4 size when an image having the A4 size is printed on the recording paper P, or label areas provided to label paper), and a blank area that defines the plurality of printing areas, and forms a plurality of images that correspond to the plurality of printing areas on a one-to-one basis (see FIG. 4), for example. Note that one printing area may be provided to each recording paper P, and one image may be formed on a plurality of sheets of recording paper P corresponding to the desired number of copies.

3. Operation of Ejecting Section and Residual Vibrations

The operation that ejects the ink from the ejecting section D, and residual vibrations produced by the ejecting section D are described below with reference to FIGS. 5 to 13.

Figure 5:
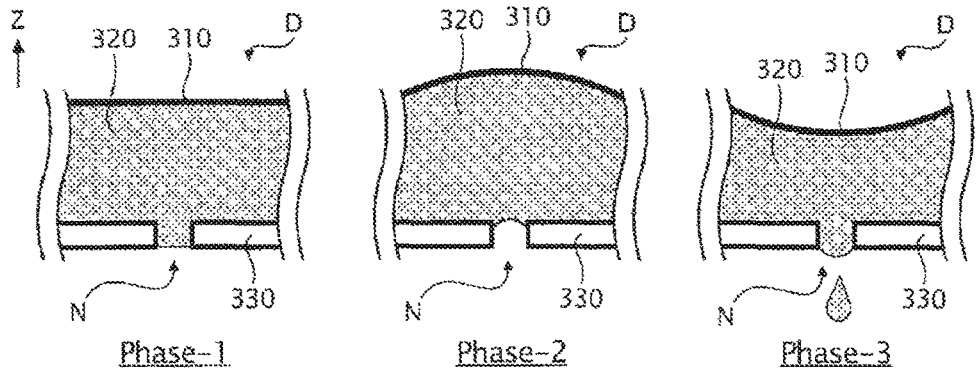
FIG. 5 illustrates a change in the cross-sectional shape of an ejecting section D when a drive signal Vin has been supplied.

FIG. 5 illustrates the operation that ejects the ink from the ejecting section D. As illustrated in FIG. 5, the drive signal generation section 51 changes the potential of the drive signal Vin supplied to the piezoelectric element 300 included in the ejecting section D in a Phase-1 state to produce a strain that displaces the piezoelectric element 300 in the +Z-direction, so that the diaphragm 310 included in the ejecting section D is warped in the +Z-direction, for example. The volume of the cavity 320 included in the ejecting section D thus increases as compared with that in the Phase-1 state (see the Phase-2 state illustrated in FIG. 5). The drive signal generation section 51 changes the potential of the drive signal Vin in the Phase-2 state to produce a strain that displaces the piezoelectric element 300 in the −Z-direction, so that the diaphragm 310 included in the ejecting section D is warped in the −Z-direction, for example. The volume of the cavity 320 thus rapidly decreases (see the Phase-3 state illustrated in FIG. 5). In this case, part of the ink with which the cavity 320 is filled is ejected through the nozzle N (that communicates with the cavity 320) as an ink droplet due to the compression pressure generated within the cavity 320.

The ejecting section D including the diaphragm 310 vibrates after the piezoelectric element 300 and the diaphragm 310 are driven based on the drive signal Vin and displaced in the Z-axis direction (see FIG. 5). The vibrations produced by the ejecting section D that has been driven based on the drive signal Vin are hereinafter referred to as "residual vibrations". It is considered that the vibrations produced by the ejecting section D have a natural resonance frequency that is determined by an acoustic resistance Res due to the shape of the nozzle N and the ink inlet 360, the viscosity of the ink, and the like, inertance Int due to the weight of the ink within the flow channel, and the compliance Cm of the diaphragm 310. A computation model that calculates the residual vibrations produced by the ejecting section D based on the above assumption is described below.

Figure 6:
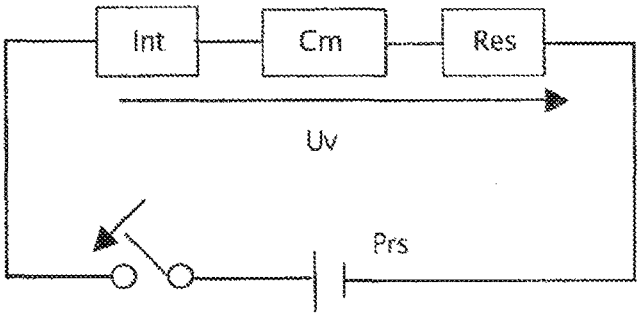
FIG. 6 is a circuit diagram illustrating a simple harmonic oscillation computation model that calculates residual vibrations produced by an ejecting section D.

FIG. 6 is a circuit diagram illustrating a simple harmonic oscillation computation model that calculates the residual vibrations produced by the diaphragm 310. As illustrated in FIG. 6, the computation model that calculates the residual vibrations produced by the diaphragm 310 is represented using a sound pressure Prs, the inertance Int, the compliance Cm, and the acoustic resistance Res. The step response with respect to the volume velocity Uv when the sound pressure Prs is applied to the circuit illustrated in FIG. 6 is calculated using the following expression.

$$Uv=\{Prs/(w\cdot Int)\}e^{-y\cdot t}\cdot\sin(wt)$$

$$w=\{1/(Int\cdot Cm)-y^2\}^{1/2}$$

$$y=Res/(2\cdot Int)$$

The calculated value obtained using the above expression is compared with the experimental result (experimental value) for the residual vibrations produced by the ejecting section D.

Figure 7:
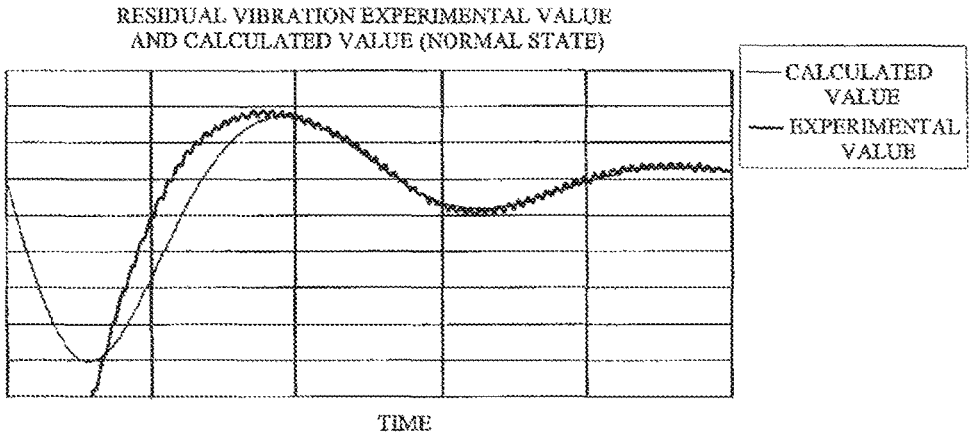
FIG. 7 is a graph illustrating the relationship between an experimental value and a calculated value with regard to residual vibrations produced by an ejecting section D.

FIG. 7 is a graph illustrating the relationship between the experimental value and the calculated value with regard to the residual vibrations. Note that the experimental value illustrated in FIG. 7 was obtained by an experiment that causes the ejecting section D in a normal ink ejection state to eject the ink, and detects the residual vibrations produced by the diaphragm 310 included in the ejecting section D. As illustrated in FIG. 7, when the ink ejection state of the ejecting section D is normal, the waveform of the experimental value and the waveform of the calculated value approximately coincide with each other.

When the ejecting section D has ejected the ink, an ink droplet may not be normally ejected through the nozzle N included in the ejecting section D (i.e., an abnormal ejection state may occur). An abnormal ejection state may occur (1) when air bubbles have been formed within the cavity 320, or (2) when the ink within the cavity 320 has increased in viscosity or become immobilized due to drying or the like, or (3) when a foreign substance (e.g., paper powder) has adhered to an area around the outlet of the nozzle N, for example.

An example is described below in which at least one of the acoustic resistance Res and the inertance Int is adjusted based on the comparison result illustrated in FIG. 7 so that the calculated value and the experimental value with regard to the residual vibrations approximately coincide with each other taking account of the cause of the abnormal ejection state (of the ejecting section D).

Figure 8:
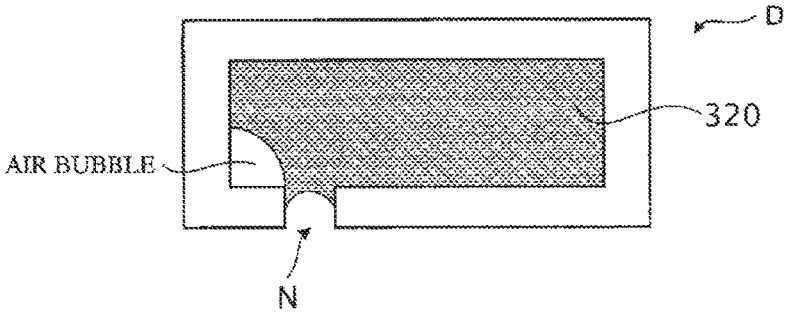
FIG. 8 illustrates the state of an ejecting section D in which air bubbles have been formed.
Figure 9:
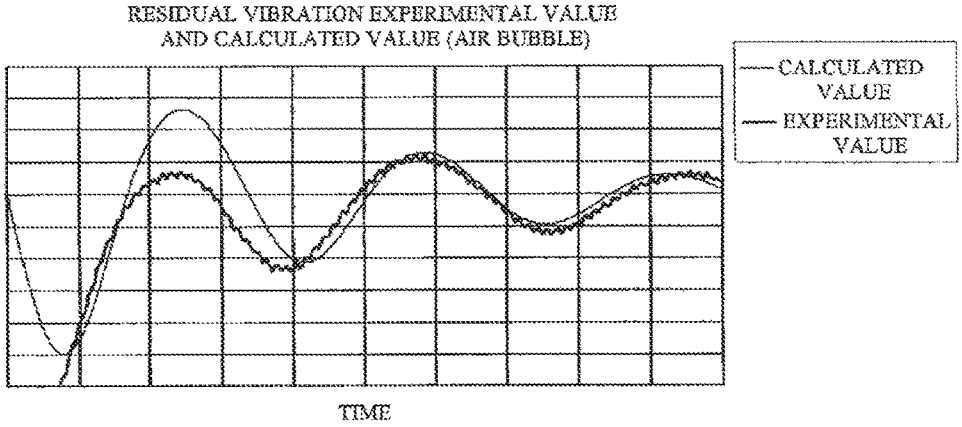
FIG. 9 is a graph illustrating an experimental value and a calculated value with regard to residual vibrations produced by an ejecting section D.

FIG. 8 schematically illustrates an abnormal ejection state that has occurred when air bubbles have been formed within the cavity 320 (see (1)). When air bubbles have been formed within the cavity 320 as illustrated in FIG. 8, it is considered that the total weight of the ink within the cavity 320 decreases, and the inertance Int decreases. When air bubbles adhere to an area around the nozzle N, the diameter of the nozzle N apparently increases by the diameter of the air bubbles, and it is considered that the acoustic resistance Res decreases. FIG. 9 illustrates a graph obtained by the matching with the residual vibration experimental values when air bubbles was formed, wherein the acoustic resistance Res and the inertance Int were set to be lower than those of the case illustrated in FIG. 7. As illustrated in FIGS. 7 and 9, the frequency of the residual vibrations increased when air bubbles were formed within the cavity 320 as compared with the case where the ejection state was normal.

Figure 10:
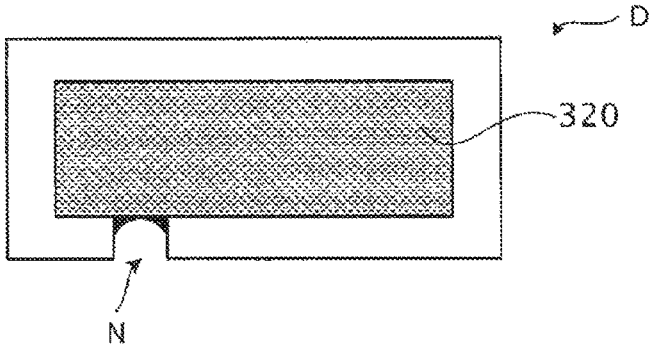
FIG. 10 illustrates the state of an ejecting section D in which an ink adheres to an area around a nozzle N.
Figure 11:
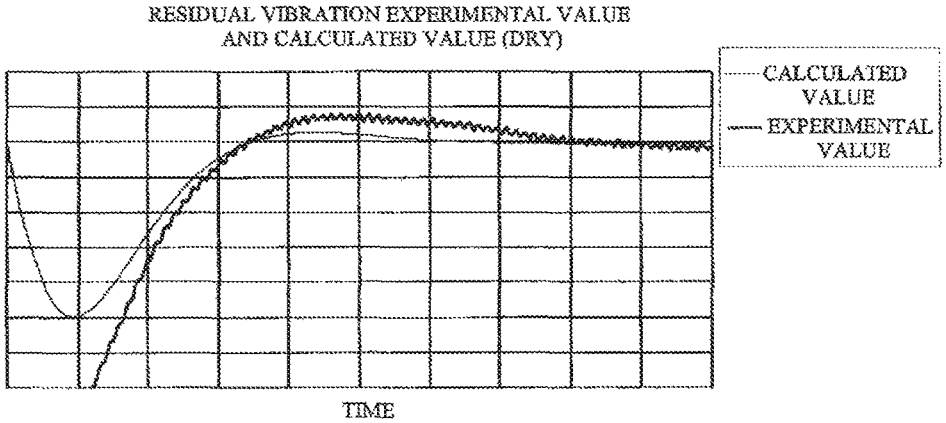
FIG. 11 is a graph illustrating an experimental value and a calculated value with regard to residual vibrations produced by an ejecting section D.

FIG. 10 schematically illustrates an abnormal ejection state that has occurred when the ink within the cavity 320 has increased in viscosity or become immobilized (see (2)). When the ink has adhered to an area around the nozzle N due to drying as illustrated in FIG. 10, the ink within the cavity 320 is confined in the cavity 320. In this case, it is considered that the acoustic resistance Res increases. FIG. 11 illustrates a graph obtained by the matching with the residual vibration experimental values when the ink situated in an area around the nozzle N became immobilized or increased in viscosity, wherein the acoustic resistance Res was set to be higher than that of the case illustrated in FIG. 7. Note that the experimental values illustrated in FIG. 11 were obtained by allowing the ejecting section D to stand in a state in which a cap (not illustrated in the drawings) was not provided, and measuring the residual vibrations produced by the diaphragm 310 included in the ejecting section D in a state in which the ink situated in an area around the nozzle N adhered. As illustrated in FIGS. 7 and 11, the frequency of the residual vibrations decreased when the ink situated in an area around the nozzle N adhered as compared with the case where the ejection state was normal, and the residual vibrations attenuated to a large extent.

Figure 12:
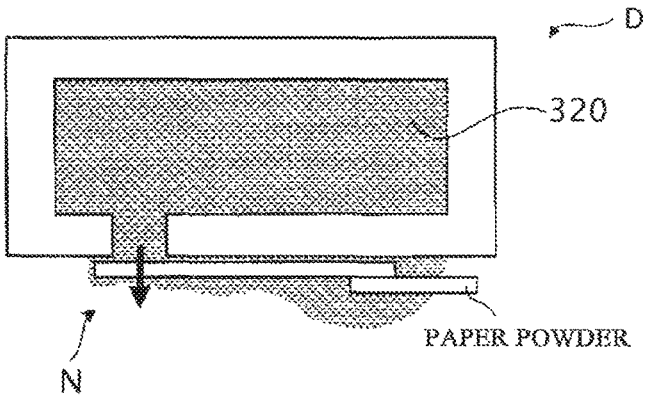
FIG. 12 illustrates the state of an ejecting section D to which a paper powder adheres.
Figure 13:
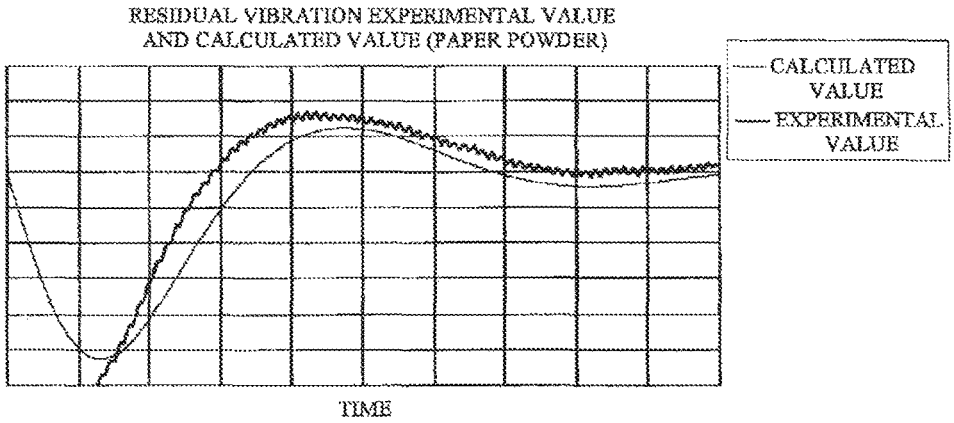
FIG. 13 is a graph illustrating an experimental value and a calculated value with regard to residual vibrations produced by an ejecting section D.

FIG. 12 schematically illustrates an abnormal ejection state that has occurred when a foreign substance (e.g., paper powder) has adhered to an area around the outlet of the nozzle N (see (3)). When a foreign substance has adhered to an area around the outlet of the nozzle N as illustrated in FIG. 12, the ink within the cavity 320 penetrates the foreign substance, and it is impossible to eject the ink through the nozzle N. When the ink seeps out of the cavity 320 through the nozzle N, it is considered that the weight of the ink with which the cavity 320 is filled has increased by the weight corresponding to the amount of ink that has seeped out of the cavity 320 as compared with the case where the ink does not seep out of the cavity 320 through the nozzle N. Specifically, when the ink seeps out of the cavity 320 through the nozzle N, it is considered that the inertance Int increases. It is considered that the acoustic resistance Res increases due to the foreign substance that has adhered to an area around the outlet of the nozzle N. FIG. 13 illustrates a graph obtained by the matching with the residual vibration experimental values when a foreign substance adhered to an area around the outlet of the nozzle N, wherein the inertance Int and the acoustic resistance Res were set to be higher than those of the case illustrated in FIG. 7. As illustrated in FIGS. 7 and 13, the frequency of the residual vibrations decreased when a foreign substance adhered to an area around the outlet of the nozzle N as compared with the case where the ejection state was normal.

Note that the frequency of the residual vibrations when a foreign substance adhered to an area around the outlet of the nozzle N (see (3)) was higher than that when the ink within the cavity 320 increased in viscosity (see (2)) (see FIGS. 11 and 13).

Specifically, it is possible to determine the ejection state of the ink from the ejecting section D based on the waveform (particularly the frequency or the cycle) of the residual vibrations produced when the ejecting section D is driven. More specifically, it is possible to determine whether or not the ejection state of the ejecting section D is normal, and determine the cause of an abnormal ejection state (see (1) to (3)) when the ejection state of the ejecting section D is abnormal, by comparing the frequency or the cycle of the residual vibrations with a predetermined threshold value. The inkjet printer 1 according to one embodiment of the invention performs the ejection state determination process that analyzes the residual vibrations, and determines the ejection state.

4. Configuration and Operation of Head Driver and Determination Unit

The head driver 5 (drive signal generation section 51, connection section 53, and detection unit 8) and the determination unit 4 are described below with reference to FIGS. 14 to 18.

4.1. Drive Signal Generation Section

Figures 14, 15:
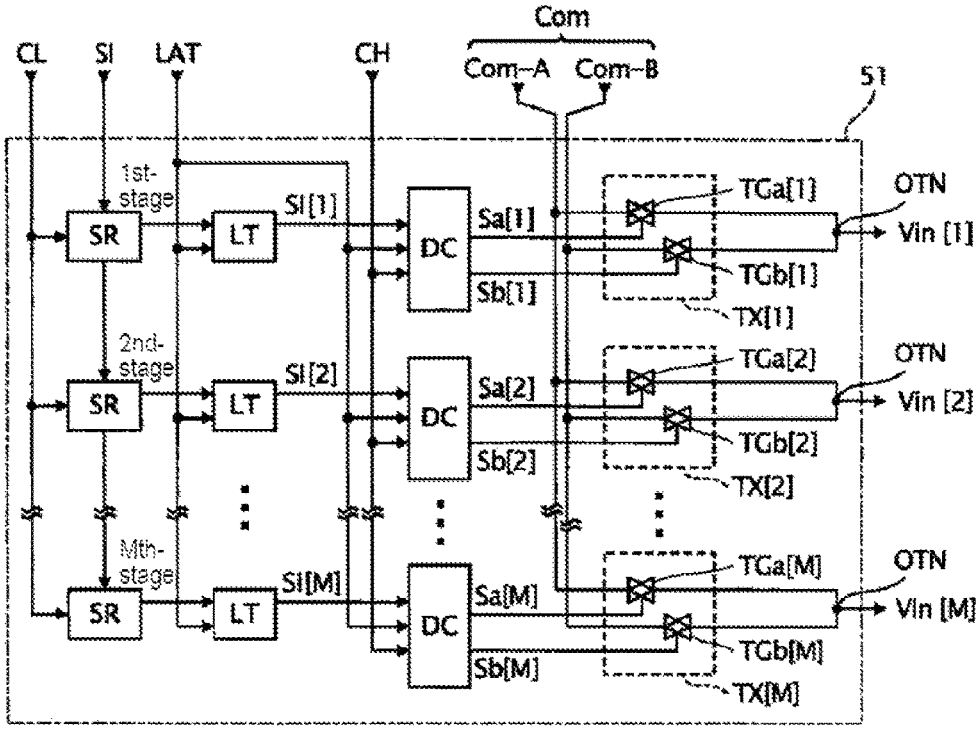
FIG. 14 is a block diagram illustrating the configuration of a drive signal generation section 51.
FIG. 15 illustrates the decoding results of a decoder DC.

FIG. 14 is a block diagram illustrating the configuration of the drive signal generation section 51 included in the head driver 5.

As illustrated in FIG. 14, the drive signal generation section 51 includes M shift registers SR, M latch circuits LT, M decoders DC, and M switch sections TX that correspond to the M ejecting sections D on a one-to-one basis. Note that these M elements (e.g., M shift registers SR) may be referred to as a first-stage element (e.g., first-stage shift register SR), a second-stage element (e.g., second-stage shift register SR), . . . , and an Mth-stage element (e.g., Mth-stage shift register SR) (see FIG. 14).

The clock signal CL, the print signal SI, a latch signal LAT, a change signal CH, and the drive waveform signal Corn (Com-A, Com-B) are supplied to the drive signal generation section 51 from the control section 6.

The drive waveform signal Com (Com-A, Com-B) is a signal that includes a plurality of waveforms for driving the ejecting section D.

The print signal SI is a digital signal that designates the waveform of the drive waveform signal Com to be supplied to each ejecting section D (i.e., designates whether or not to eject the ink from each ejecting section D, and designates the ejection volume of the ink from each ejecting section D). The print signal SI includes print signals SI[1] to SI[M]. The print signal SI[m] designates whether or not to eject the ink from the ejecting section D[m], and designates the ejection volume of the ink from the ejecting section D[m] using 2 bits (i.e., bits b1 and b2).

Specifically, the print signal SI[m] causes the ejecting section D[m] to eject the ink in such a volume that the ink forms a large dot, or causes the ejecting section D[m] to eject the ink in such a volume that the ink forms a medium dot, or causes the ejecting section D[m] to eject the ink in such a volume that the ink forms a small dot, or does not cause the ejecting section D[m] to eject the ink. More specifically, the 2-bit information (b1, b2) included in the print signal SI[m] represents (1, 1) when the print signal SI[m] causes the ejecting section D[m] to eject the ink in such a volume that the ink forms a large dot, represents (1, 0) when the print signal SI[m] causes the ejecting section D[m] to eject the ink in such a volume that the ink forms a medium dot, represents (0, 1) when the print signal SI[m] causes the ejecting section D[m] to eject the ink in such a volume that the ink forms a small dot, and represents (0, 0) when the print signal SI[m] does not cause the ejecting section D[m] to eject the ink (see FIG. 15).

The drive signal generation section 51 supplies the drive signal Vin having the waveform designated by the print signal SI[m] to the ejecting section D[m]. Note that the drive signal Vin that has the waveform designated by the print signal SI[m] and is supplied to the ejecting section D[m] is referred to as "drive signal Vin[m]".

The shift register SR temporarily holds the print signal SI (SI[1] to SI[M]) supplied in series on a 2 bit basis corresponding to each ejecting section D. More specifically, the M shift registers SR (i.e., first-stage shift register SR, second-stage shift register SR, . . . , and Mth-stage shift register SR) that correspond to the M ejecting sections D on a one-to-one basis are cascade-connected so that the print signal SI supplied in series is sequentially transferred to the subsequent stage according to the clock signal CL. Each of the M shift registers SR holds the corresponding 2-bit data included in the print signal SI when the print signal SI has been transferred to each of the M shift registers SR. Note that the mth-stage shift register SR may be hereinafter referred to as "shift register SR[m]".

Each of the M latch circuits LT simultaneously latches the 2-bit print signal SI[m](corresponding to each stage) held by each of the M shift registers SR at a rise timing of the latch signal LAT. Specifically, the mth-stage latch circuit LT latches the print signal SI[m] held by the shift register SR[m].

An operation period in which the inkjet printer 1 performs the printing process or the ejection state determination process includes a plurality of unit periods Tu.

The control section 6 supplies the print signal SI and the drive waveform signal Com to the drive signal generation section 51 every unit period Tu, and supplies the latch signal LAT that causes the latch circuit LT to latch the print signal SI[m] every unit period Tu. The control section 6 thus controls the drive signal generation section 51 so that the drive signal generation section 51 supplies the drive signal Vin[m] to the ejecting section D[m], the drive signal Vin[m] causing the ejecting section D[m] to eject the ink in such a volume that the ink forms a large dot, or causing the ejecting section D[m] to eject the ink in such a volume that the ink forms a medium dot, or causing the ejecting section D[m] to eject the ink in such a volume that the ink forms a small dot, or not causing the ejecting section D[m] to eject the ink, in each unit period Tu.

Note that the control section 6 divides the unit period Tu into a control period Ts1 and a control period Ts2 using the change signal CH. The control period Ts1 and the control period Ts2 have the same time length. The control period Ts1 and the control period Ts2 may be hereinafter collectively referred to as "control period Ts".

The decoder DC decodes the print signal SI[m] latched by the latch circuit LT, and outputs a selection signal Sa[m] and a selection signal Sb[m].

FIG. 15 illustrates the decoding result of the mth-stage decoder DC in each unit period Tu. As illustrated in FIG. 15, the mth-stage decoder DC outputs the selection signal Sa[m] and the selection signal Sb[m] in each of the control period Ts1 and the control period Ts2 included in each unit period Tu. The decoder DC sets the selection signal Sa[m] and the selection signal Sb[m] to the H level and the L level, respectively, in the control period Ts1 when the bit b1 represented by the print signal SI[m] is "1", and sets the selection signal Sa[m] and the selection signal Sb[m] to the L level and the H level, respectively, in the control period Ts1 when the bit b1 represented by the print signal SI[m] is "0". The decoder DC sets the selection signal Sa[m] and the selection signal Sb[m] to the H level and the L level, respectively, in the control period Ts2 when the bit b2 represented by the print signal SI[m] is "1", and sets the selection signal Sa[m] and the selection signal Sb[m] to the L level and the H level, respectively, in the control period Ts2 when the bit b2 represented by the print signal SI[m] is "0".

For example, when the print signal SI[m] supplied in the unit period Tu is (b1, b2)=(1, 0), the mth-stage decoder DC sets the selection signal Sa[m] and the selection signal Sb[m] to the H level and the L level, respectively, in the control period Ts1, and sets the selection signal Sb[m] and the selection signal Sa[m] to the H level and the L level, respectively, in the control period Ts2.

As illustrated in FIG. 14, the drive signal generation section 51 includes the M switch sections TX that correspond to the M ejecting sections D on a one-to-one basis. The mth-stage switch section TX[m] includes a transmission gate TGa[m] that is turned ON when the selection signal Sa[m] is set to the H level, and is turned OFF when the selection signal Sa[m] is set to the L level, and a transmission gate TGb[m] that is turned ON when the selection signal Sb[m] is set to the H level, and is turned OFF when the selection signal Sb[m] is set to the L level.

As illustrated in FIG. 14, the drive waveform signal Com-A is supplied to one end of the transmission gate TGa[m], and the drive waveform signal Com-B is supplied to one end of the transmission gate TGb[m]. The other end of the transmission gate TGa[m] and the other end of the transmission gate TGb[m] are electrically connected to an mth-stage output terminal OTN.

As illustrated in FIG. 15, the switch section TX[m] is controlled so that one of the transmission gate TGa[m] and the transmission gate TGb[m] is turned ON and the other of the transmission gate TGa[m] and the transmission gate TGb[m] is turned OFF in each control period Ts. Specifically, the switch section TX[m] supplies the drive waveform signal Com-A or the drive waveform signal Com-B to the ejecting section D[m] as the drive signal Vin[m] through the mth-stage output terminal OTN in each control period Ts.

Figure 16:
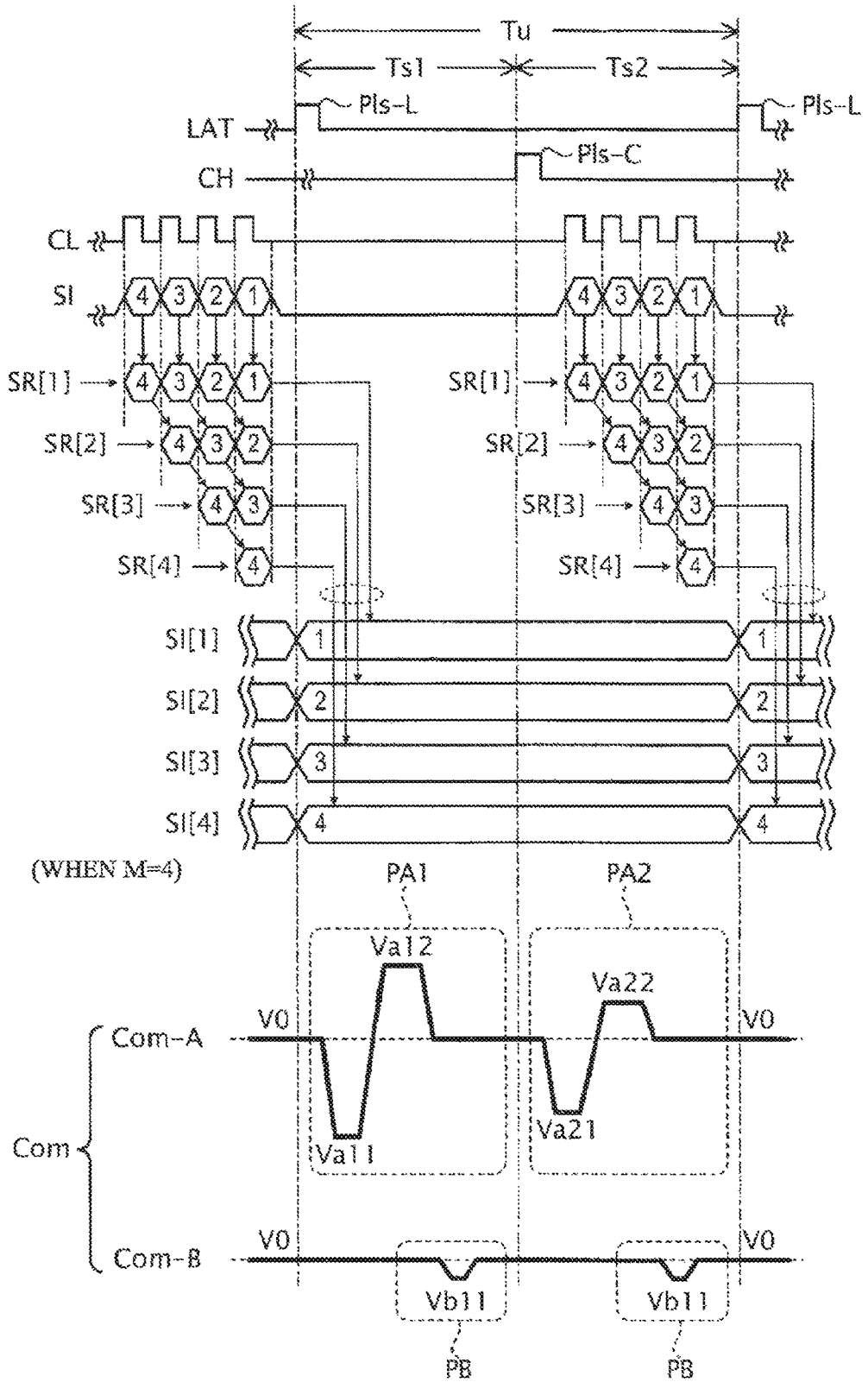
FIG. 16 is a timing chart illustrating the operation of a drive signal generation section 51.
Figure 17:
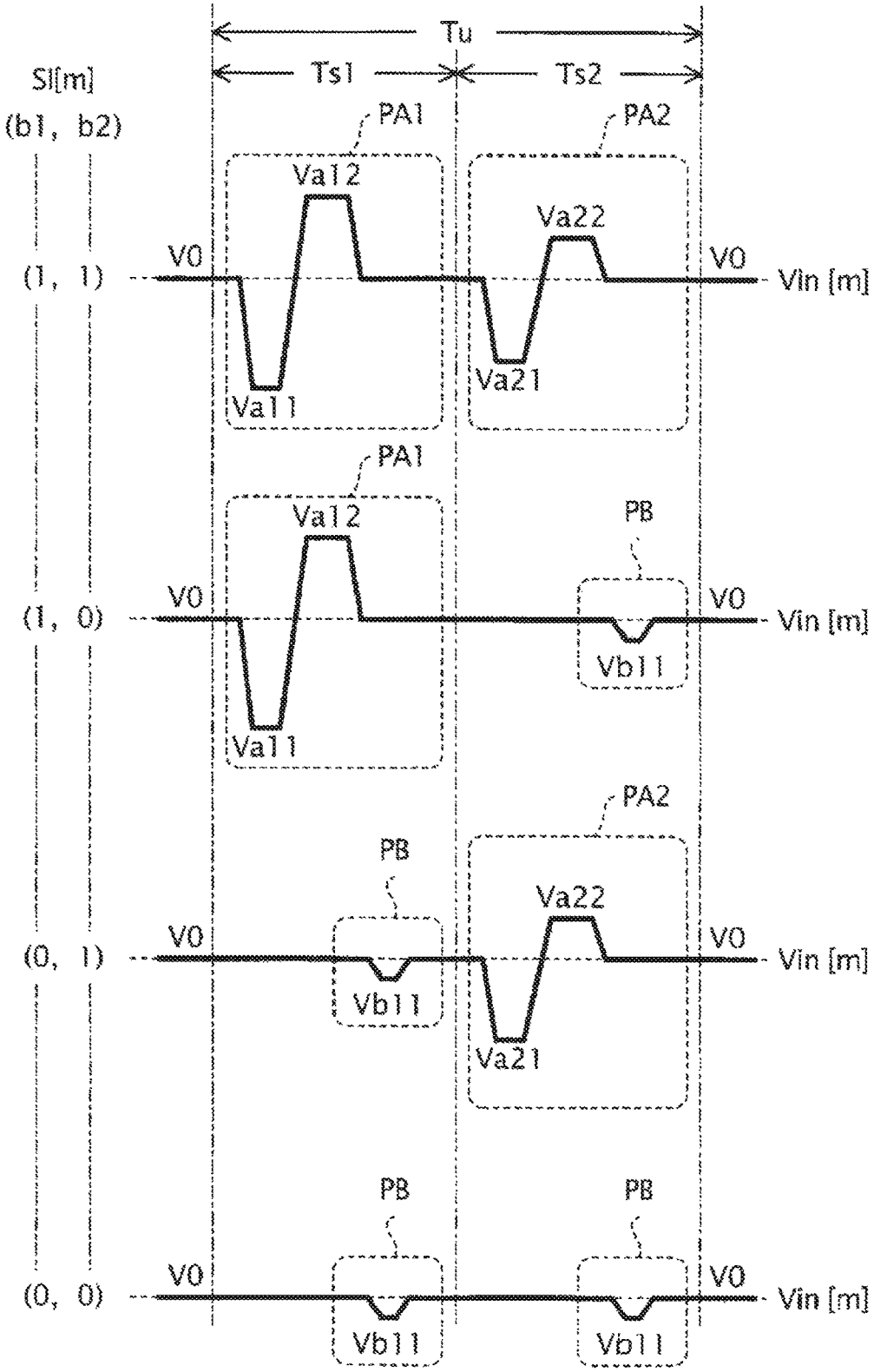
FIG. 17 is a timing chart illustrating the waveform of a drive signal Vin.

FIG. 16 is a timing chart illustrating the signals supplied from the control section 6 to the drive signal generation section 51 in each unit period Tu, and the operation of the drive signal generation section 51 in each unit period Tu. Note that FIG. 16 illustrates an example in which M=4 for convenience of illustration.

As illustrated in FIG. 16, the unit period Tu is defined by a pulse Pls-L included in the latch signal LAT, and the control period Ts1 and the control period Ts2 are defined by a pulse Pls-C included in the change signal CH.

The control section 6 supplies the print signal SI to the drive signal generation section 51 in synchronization with the clock signal CL prior to the start of each unit period Tu. Each shift register SR included in the drive signal generation section 51 sequentially shifts the supplied print signal SI[m] to the subsequent stage in synchronization with the clock signal CL.

As illustrated in FIG. 16, the drive waveform signal Com-A that is output from the control section 6 in each unit period Tu includes an ejection waveform PA1 (hereinafter may be referred to as "waveform PA1") that is provided to the control period Ts1, and an ejection waveform PA2 (hereinafter may be referred to as "waveform PA2") that is provided to the control period Ts2.

When the drive signal Vin[m] having the waveform PA1 is supplied to the ejecting section D[m], the ejecting section D[m] ejects the ink in such a volume that the ink forms a medium dot.

When the drive signal Vin[m] having the waveform PA2 is supplied to the ejecting section D[m], the ejecting section D[m] ejects the ink in such a volume that the ink forms a small dot.

For example, the difference between the lowest potential (e.g., potential Va11) and the highest potential (e.g., potential Va12) of the waveform PA1 is larger than the difference between the lowest potential (e.g., potential Va21) and the highest potential (e.g., potential Va22) of the waveform PA2.

As illustrated in FIG. 16, the drive waveform signal Com-B that is output from the control section 6 in each unit period Tu includes a micro-vibration waveform PB (hereinafter may be referred to as "waveform PB").

When the drive signal Vin[m] having the waveform PB is supplied to the ejecting section D[m], the ejecting section D[m] does not eject the ink. Specifically, the waveform PB is a waveform that prevents an increase in the viscosity of the ink by finely vibrating the ink contained in the ejecting section D. For example, the difference between the lowest potential (e.g., potential Vb11) and the highest potential (e.g., reference potential V0) of the waveform PB is smaller than the difference between the lowest potential and the highest potential of the waveform PA2.

The drive signal Vin that is output from the drive signal generation section 51 in the unit period Tu is described below with reference to FIGS. 14 to 17.

When the print signal SI[m] supplied in the unit period Tu represents (1, 1), the selection signal Sa[m] is set to the H level in the control period Ts1 and the control period Ts2 (see FIG. 15). The switch section TX[m] selects the drive waveform signal Com-A in the control period Ts1 to output the drive signal Vin[m] having the waveform PA1, and selects the drive waveform signal Com-A in the control period Ts2 to output the drive signal Vin[m] having the waveform PA2. In this case, the drive signal Vin[m] supplied to the ejecting section D[m] in the unit period Tu includes the waveform PA1 and the waveform PA2 (see FIG. 17). Therefore, the ejecting section D[m] ejects a medium volume of ink based on the waveform PA1 and a small volume of ink based on the waveform PA2 in the unit period Tu to form a large dot on the recording paper P.

When the print signal SI[m] supplied in the unit period Tu represents (1, 0), the selection signal Sa[m] is set to the H level in the control period Ts1, and the selection signal Sb[m] is set to the H level in the control period Ts2 (see FIG. 15). The switch section TX[m] selects the drive waveform signal Com-A in the control period Ts1 to output the drive signal Vin[m] having the waveform PA1, and selects the drive waveform signal Com-B in the control period Ts2 to output the drive signal Vin[m] having the waveform PB. In this case, the drive signal Vin[m] supplied to the ejecting section D[m] in the unit period Tu includes the waveform PA1 and the waveform PB (see FIG. 17). Therefore, the ejecting section D[m] ejects a medium volume of ink based on the waveform PA1 in the unit period Tu to form a medium dot on the recording paper P.

When the print signal SI[m] supplied in the unit period Tu represents (0, 1), the selection signal Sb[m] is set to the H level in the control period Ts1, and the selection signal Sa[m] is set to the H level in the control period Ts2 (see FIG. 15). The switch section TX[m] selects the drive waveform signal Com-B in the control period Ts1 to output the drive signal Vin[m] having the waveform PB, and selects the drive waveform signal Com-A in the control period Ts2 to output the drive signal Vin[m] having the waveform PA2. In this case, the drive signal Vin[m] supplied to the ejecting section D[m] in the unit period Tu includes the waveform PA2 and the waveform PB (see FIG. 17). Therefore, the ejecting section D[m] ejects a small volume of ink based on the waveform PA2 in the unit period Tu to form a small dot on the recording paper P.

When the print signal SI[m] supplied in the unit period Tu represents (0, 0), the selection signal Sb[m] is set to the H level in the control period Ts1 and the control period Ts2 (see FIG. 15). The switch section TX[m] selects the drive waveform signal Com-B in the control period Ts1 and the control period Ts2 to output the drive signal Vin[m] having the waveform PB. In this case, the drive signal Vin[m] supplied to the ejecting section D[m] in the unit period Tu includes the waveform PB (see FIG. 17). Therefore, the ejecting section D[m] does not eject the ink in the unit period Tu, and a dot is not formed on the recording paper P (i.e., an image is not recorded).

Note that the control section 6 designates the target ejecting section Dtg (for which the residual vibrations are detected by the ejection state determination process in the unit period Tu) from the ejecting sections D[m] to which the drive signal Vin[m] having the waveform PA1 is supplied in the unit period Tu (i.e., the ejecting sections D[m] to which the print signal SI[m] that represents (1, 1) or (1, 0) is supplied). Specifically, the waveform PA1 of the drive signal Vin[m] that is supplied to the ejecting section D[m] designated as the target ejecting section Dtg also serves as a determination drive waveform (i.e., drive waveform) for driving the target ejecting section Dtg (for which the residual vibrations are detected by the ejection state determination process) to produce the residual vibrations.

4.2. Connection Section

Figure 18:
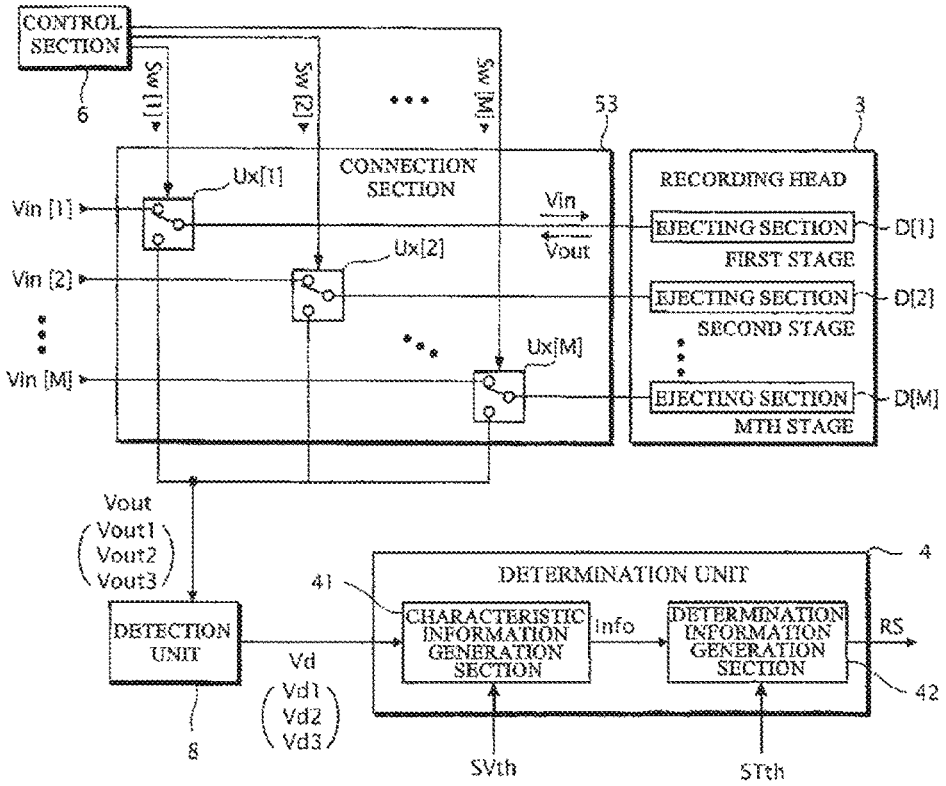
FIG. 18 illustrates the connection relationship between a connection section 53 and a detection unit 8.

FIG. 18 is a block diagram illustrating the connection relationship between the recording head 3, the connection section 53, the detection unit 8, and the determination unit 4, the configuration of the connection section 53, and the configuration of the determination unit 4.

As illustrated in FIG. 18, the connection section 53 includes M (first-stage to Mth-stage) connection circuits Ux (Ux[1], Ux[2], . . . , and Ux[M]) that correspond to the M ejecting sections D on a one-to-one basis. The mth-stage connection circuit Ux[m] electrically connects the upper electrode 302 of the piezoelectric element 300 included in the ejecting section D[m] to the mth-stage output terminal OTN of the drive signal generation section 51, or the detection unit 8.

A state in which the connection circuit Ux[m] electrically connects the ejecting section D[m] to the mth-stage output terminal OTN of the drive signal generation section 51 is hereinafter referred to as "first connection state". A state in which the connection circuit Ux[m] electrically connects the ejecting section D[m] to the detection unit 8 is hereinafter referred to as "second connection state".

When the control section 6 designates the ejecting section D[m] as the target ejecting section Dtg in the unit period Tu, the connection circuit Ux[m] is set to the second connection state in a detection period Td within the unit period Tu to electrically connect the ejecting section D[m] to the detection unit 8. When the control section 6 designates the ejecting section D[m] as the target ejecting section Dtg in the unit period Tu, the connection circuit Ux[m] is set to the first connection state in a period within the unit period Tu other than the detection period Td to electrically connect the ejecting section D[m] to the drive signal generation section 51. When the control section 6 does not designate the ejecting section D[m] as the target ejecting section Dtg in the unit period Tu, the connection circuit Ux[m] is set to the first connection state in the entire unit period Tu to electrically connect the ejecting section D[m] to the drive signal generation section 51.

The control section 6 outputs a connection control signal Sw that controls the connection of each connection circuit Ux, to each connection circuit Ux.

Specifically, when the control section 6 designates the ejecting section D[m] as the target ejecting section Dtg in the unit period Tu, the control section 6 supplies the connection control signal Sw[m] to the connection circuit Ux[m] so that the connection circuit Ux[m] is set to the first connection state in a period within the unit period Tu other than the detection period Td, and is set to the second connection state in the detection period Td within the unit period Tu. Therefore, when the control section 6 designates the ejecting section D[m] as the target ejecting section Dtg in the unit period Tu, the drive signal Vin[m] is supplied to the ejecting section D[m] from the drive signal generation section 51 in a period within the unit period Tu other than the detection period Td, and the residual vibration signal Vout is supplied to the detection unit 8 from the ejecting section D[m] in the detection period Td within the unit period Tu.

When the control section 6 does not designate the ejecting section D[m] as the target ejecting section Dtg in the unit period Tu, the control section 6 supplies the connection control signal Sw[m] that sets the connection circuit Ux[m] to the first connection state in the entire unit period Tu, to the connection circuit Ux[m].

Note that the detection period Td includes a detection period Td1 (i.e., first period), a detection period Td2 (i.e., second period), and a detection period Td3 (i.e., third period) (as described in detail later) (see FIG. 19).

As illustrated in FIG. 18, the inkjet printer 1 includes one detection unit 8 corresponding to the M ejecting sections D, and each detection unit 8 can detect only the residual vibrations produced by one ejecting section D in one unit period Tu. Specifically, the control section 6 designates one ejecting section D among the M ejecting sections D as the target ejecting section Dtg in one unit period Tu.

4.3. Detection Unit

The detection unit 8 illustrated in FIG. 18 generates the shaped waveform signal Vd based on the residual vibration signal Vout (see above). The shaped waveform signal Vd is a signal obtained by amplifying the amplitude of the residual vibration signal Vout, and removing a noise component from the residual vibration signal Vout (i.e., a signal obtained by shaping the residual vibration signal Vout so as to have a waveform that is suitable for the process performed by the determination unit 4).

The detection unit 8 may include a negative feedback amplifier that amplifies the residual vibration signal Vout, a low-pass filter that attenuates the high-frequency component of the residual vibration signal Vout, and a voltage follower that performs an impedance conversion process, and outputs the shaped waveform signal Vd having a low impedance, for example.

Note that the residual vibration signal Vout detected from the ejecting section D[m] (designated as the target ejecting section Dtg in the unit period Tu) in the detection period Td1 within the unit period Tu may be referred to as "residual vibration signal Vout1", the residual vibration signal Vout detected from the ejecting section D[m] (designated as the target ejecting section Dtg in the unit period Tu) in the detection period Td2 within the unit period Tu may be referred to as "residual vibration signal Vout2", and the residual vibration signal Vout detected from the ejecting section D[m] (designated as the target ejecting section Dtg in the unit period Tu) in the detection period Td3 within the unit period Tu may be referred to as "residual vibration signal Vout3".

The shaped waveform signal Vd that is generated by the detection unit 8 based on the residual vibration signal Vout1 may be referred to as "shaped waveform signal Vd1" (i.e., first detection signal), the shaped waveform signal Vd that is generated by the detection unit 8 based on the residual vibration signal Vout2 may be referred to as "shaped waveform signal Vd2" (i.e., second detection signal), and the shaped waveform signal Vd that is generated by the detection unit 8 based on the residual vibration signal Vout3 may be referred to as "shaped waveform signal Vd3" (i.e., third detection signal).

4.4. Determination Unit

The determination unit 4 determines the ejection state of the ink from the ejecting section D based on the shaped waveform signal Vd output from the detection unit 8, and generates the determination information RS that represents the determination result.

As illustrated in FIG. 18, the determination unit 4 includes a characteristic information generation section 41 that generates characteristic information Info that represents the characteristics of the residual vibrations produced by the ejecting section D[m], and a determination information generation section 42 that determines the ejection state of the ink from the ejecting section D[m], and generates the determination information RS[m] that represents the determination result.

A threshold potential signal SVth that represents threshold potentials used to determine the characteristics of the residual vibrations represented by the shaped waveform signal Vd is supplied to the characteristic information generation section 41 from the control section 6. The characteristic information generation section 41 compares the threshold potentials represented by the threshold potential signal SVth with the potential represented by the shaped waveform signal Vd to determine the characteristics of the residual vibrations represented by the shaped waveform signal Vd generated by the detection unit 8, and generates the characteristic information Info that represents the characteristics of the residual vibrations thus determined.

Reference information STth that represents a determination reference for the ejection state of the ink from the ejecting section D is supplied to the determination information generation section 42 from the control section 6. The determination information generation section 42 compares the characteristic information Info generated by the characteristic information generation section 41 with a reference value represented by the reference information STth to determine the ejection state of the ink from the ejecting section D[m], and generates the determination information RS[m] that represents the determination result.

5. Ejection State Determination Process

The ejection state determination process is described below with reference to FIGS. 19 to 22C.

The ejection state determination process is a process performed by the inkjet printer 1 that drives the ejecting section D[m] designated as the target ejecting section Dtg using the drive signal Vin[m] having the waveform PA1 (i.e., determination drive waveform), causes the detection unit 8 to detect the residual vibrations produced by the ejecting section D[m], and causes the determination unit 4 to generate the determination information RS[m] the represents the ejection state of the ink from the ejecting section D[m] based on the detection result of the detection unit 8.

The waveform PA1 (i.e., determination drive waveform) of the drive signal Vin[m] supplied to the target ejecting section Dtg during the ejection state determination process, and the detection period Td for detecting the residual vibrations produced by the target ejecting section Dtg, are described below with reference to FIG. 19.

Figure 19:
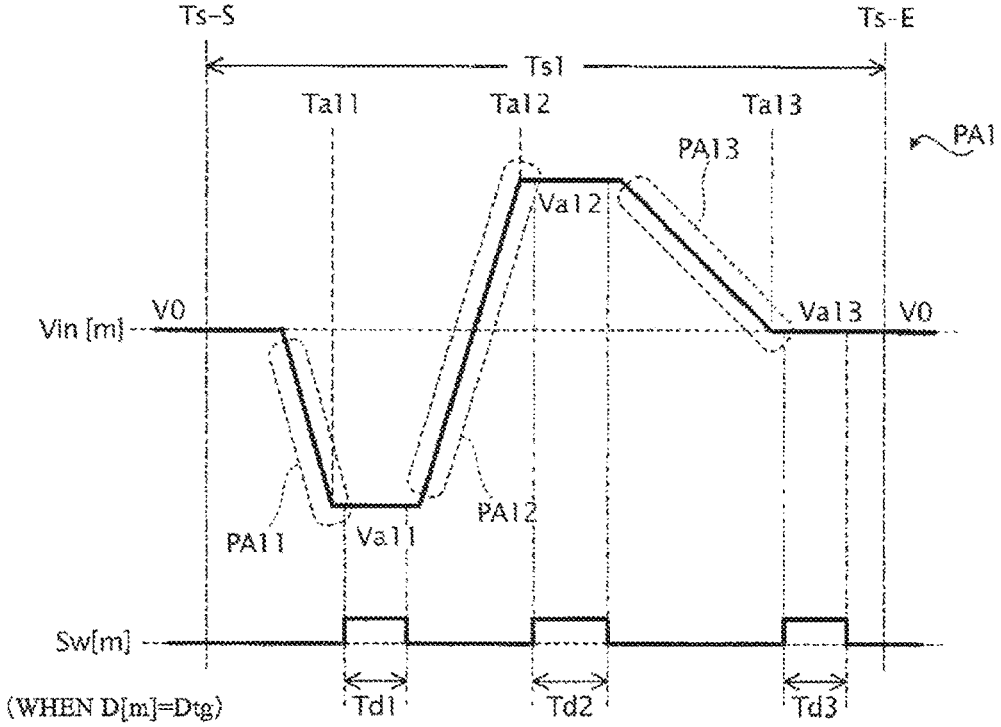
FIG. 19 is a timing chart illustrating a waveform PA1.

FIG. 19 is a timing chart illustrating the details of the waveform PA1 (i.e., determination drive waveform) illustrated in FIG. 16. As illustrated in FIG. 19, the waveform PA1 represents the reference potential V0 at a time Ts-S (i.e., first time) (i.e., the start timing of the waveform PA1), decreases to a potential Va11 (i.e., first potential) lower than the reference potential V0 by a time Ta11, increases to a potential Va12 (i.e., second potential) higher than the potential Va11 by a time Ta12, decreases to a potential Va13 (i.e., third potential) lower than the potential Va12 by a time Ta13, and maintains the potential Va13 up to a time Ts-E (i.e., second time) (i.e., the end timing of the waveform PA1).

In one embodiment of the invention, the potential Va13 is equal to the reference potential V0. Specifically, the third potential is used as the reference potential V0. The difference between the potential Va13 and the potential Va11 is larger than the difference between the potential Va12 and the potential Va13.

The unit period Tu includes the detection period Td1, the detection period Td2, and the detection period Td3 as the detection period Td for detecting the residual vibrations. Specifically, the detection period Td1 is set within the period in which the waveform PA1 is maintained at the potential Va11 within the period of the waveform PA1 from the time Ta11 to the time Ta12, the detection period Td2 is set within the period in which the waveform PA1 is maintained at the potential Va12 within the period of the waveform PA1 from the time Ta12 to the time Ta13, and the detection period Td3 is set within the period in which the waveform PA1 is maintained at the reference potential V0 within the period of the waveform PA1 from the time Ta13 to the time Ts-E (see FIG. 19). Note that the detection period Td1, the detection period Td2, and the detection period Td3 are shorter than a time Tc that corresponds to one cycle of the residual vibration signal Vout detected from the target ejecting section Dtg in a normal ejection state (see FIG. 20).

According to one embodiment of the invention, since the potential represented by the waveform PA1 is maintained at a constant level in each of the detection period Td1, the detection period Td2, and the detection period Td3, it is possible to reduce noise derived from the drive waveform signal Com that is superimposed on the detected residual vibrations, and accurately detect the residual vibrations.

When the control section 6 designates the ejecting section D[m] as the target ejecting section Dtg, the control section 6 supplies the connection control signal Sw[m] to the switch section TX[m] so that the switch section TX[m] is set to the second connection state in the detection period Td1, the detection period Td2, and the detection period Td3 within the unit period Tu, and is set to the first connection state in a period within the unit period Tu other than the detection period Td1, the detection period Td2, and the detection period Td3.

Note that part of the waveform PA1 in which the potential changes from the reference potential V0 to the potential Va11 between the time Ts-S (i.e., the start timing of the waveform PA1) and the time Ta11 is referred to as "waveform PA11" (i.e., first waveform), part of the waveform PA1 in which the potential changes from the potential Va11 to the potential Va12 between the time Ta11 and the time Ta12 is referred to as "waveform PA12" (i.e., second waveform), and part of the waveform PA1 in which the potential changes from the potential Va12 to the reference potential V0 between the time Ta12 and the time Ta13 is referred to as "waveform PA13" (i.e., third waveform) (see FIG. 19).

The residual vibration signal Vout (Vout1, Vout2, and Vout3) detected in each of the detection period Td1, the detection period Td2, and the detection period Td3 is described below with reference to FIG. 20.

Figure 20:
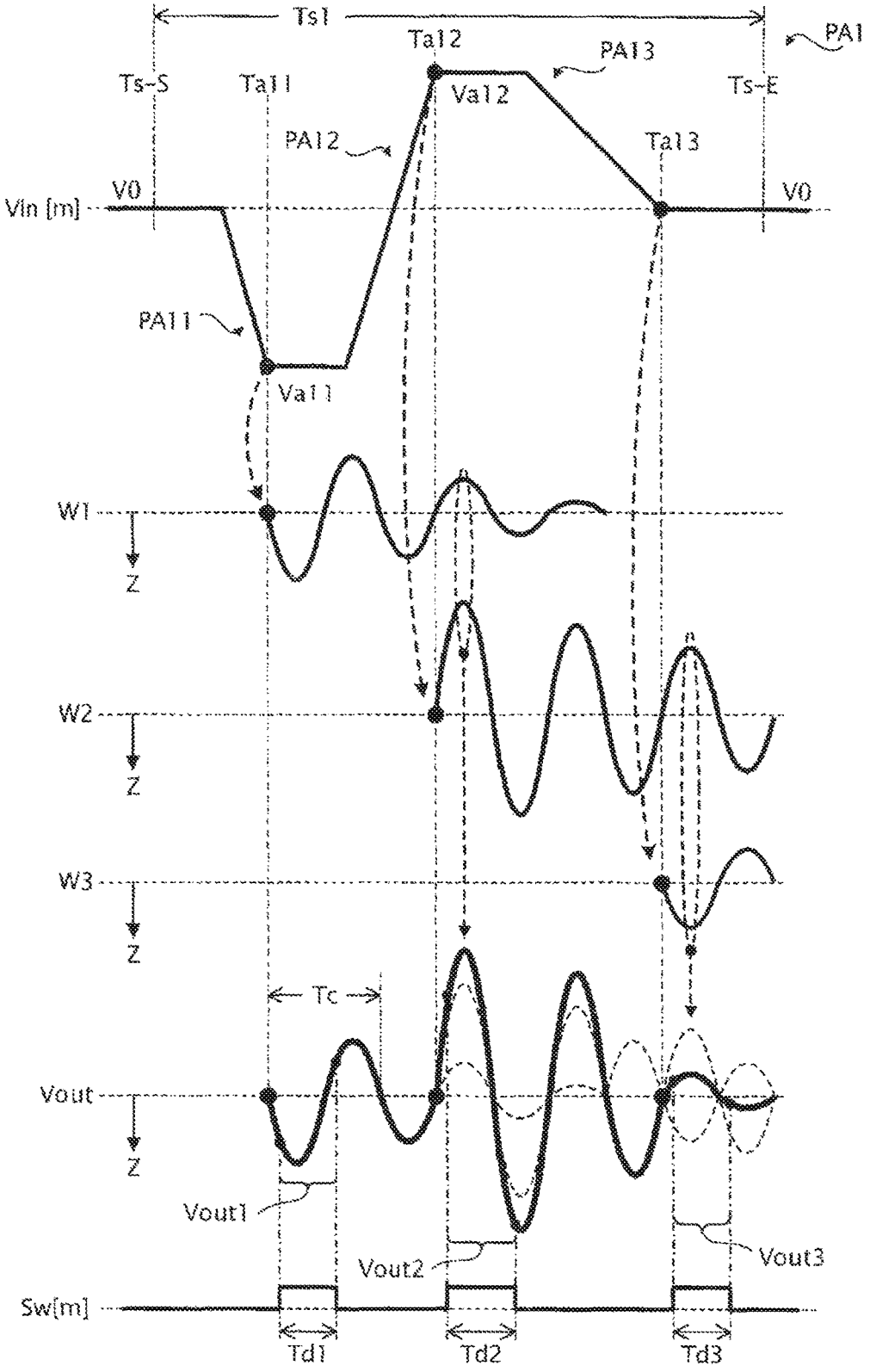
FIG. 20 illustrates residual vibrations produced by an ejecting section D in a normal ejection state.

Note that the relationship between the shape of the waveform PA1 (i.e., determination drive waveform) and the waveform of the residual vibrations produced by the ejecting section D[m] illustrated in FIG. 20 is merely an example, and the invention is not limited to the example illustrated in FIG. 20.

FIG. 20 illustrates an example in which the ejecting section D[m] driven by the drive signal Vin[m] having the waveform PA1 produces residual vibrations W1 derived from the waveform PA11 at the time Ta11 (i.e., the end timing of the waveform PA11). In the example illustrated in FIG. 20, the ejecting section D[m] produces the residual vibrations W1 in which the diaphragm 310 is displaced in the +Z-direction at the time Ta11, and then vibrates in the −Z-direction and the +Z-direction. In the example illustrated in FIG. 20, the residual vibrations W1 are detected as the residual vibration signal Vout1 in the detection period Td1 that is set after the time Ta11.

FIG. 20 illustrates an example in which the ejecting section D[m] driven by the drive signal Vin[m] having the waveform PA1 produces residual vibrations W2 derived from the waveform PA12 at the time Ta12 (i.e., the end timing of the waveform PA12). In the example illustrated in FIG. 20, composite vibrations in which the residual vibrations W2 are superimposed on the residual vibrations W1 are detected as the residual vibration signal Vout2 in the detection period Td2.

FIG. 20 illustrates an example in which the ejecting section D[m] driven by the drive signal Vin[m] having the waveform PA1 produces residual vibrations W3 derived from the waveform PA13 at the time Ta13 (i.e., the end timing of the waveform PA13). In the example illustrated in FIG. 20, composite vibrations in which the residual vibrations W3 are superimposed on the residual vibrations W1 and the residual vibrations W2 are detected as the residual vibration signal Vout3 in the detection period Td3.

Note that the ejecting section D[m] produces residual vibrations in the following cases (1) to (3), for example.

(1) When a transition occurs from a state in which the signal level of the drive signal Vin[m] changes to a state in which the signal level of the drive signal Vin[m] is held at a constant level.

(2) When a transition occurs from a state in which the signal level of the drive signal Vin[m] is held at a constant level to a state in which the signal level of the drive signal Vin[m] changes.

(3) When the signal level of the drive signal Vin[m] changes.

Specifically, when the drive signal Vin[m] illustrated in FIG. 19 is supplied to the ejecting section D[m], the ejecting section D[m] may produce residual vibrations at the start timing of the waveform PA11, the start timing of the waveform PA12, the start timing of the waveform PA13, and the like, in addition to the residual vibrations W1, the residual vibrations W2, and the residual vibrations W3.

Figure 21:
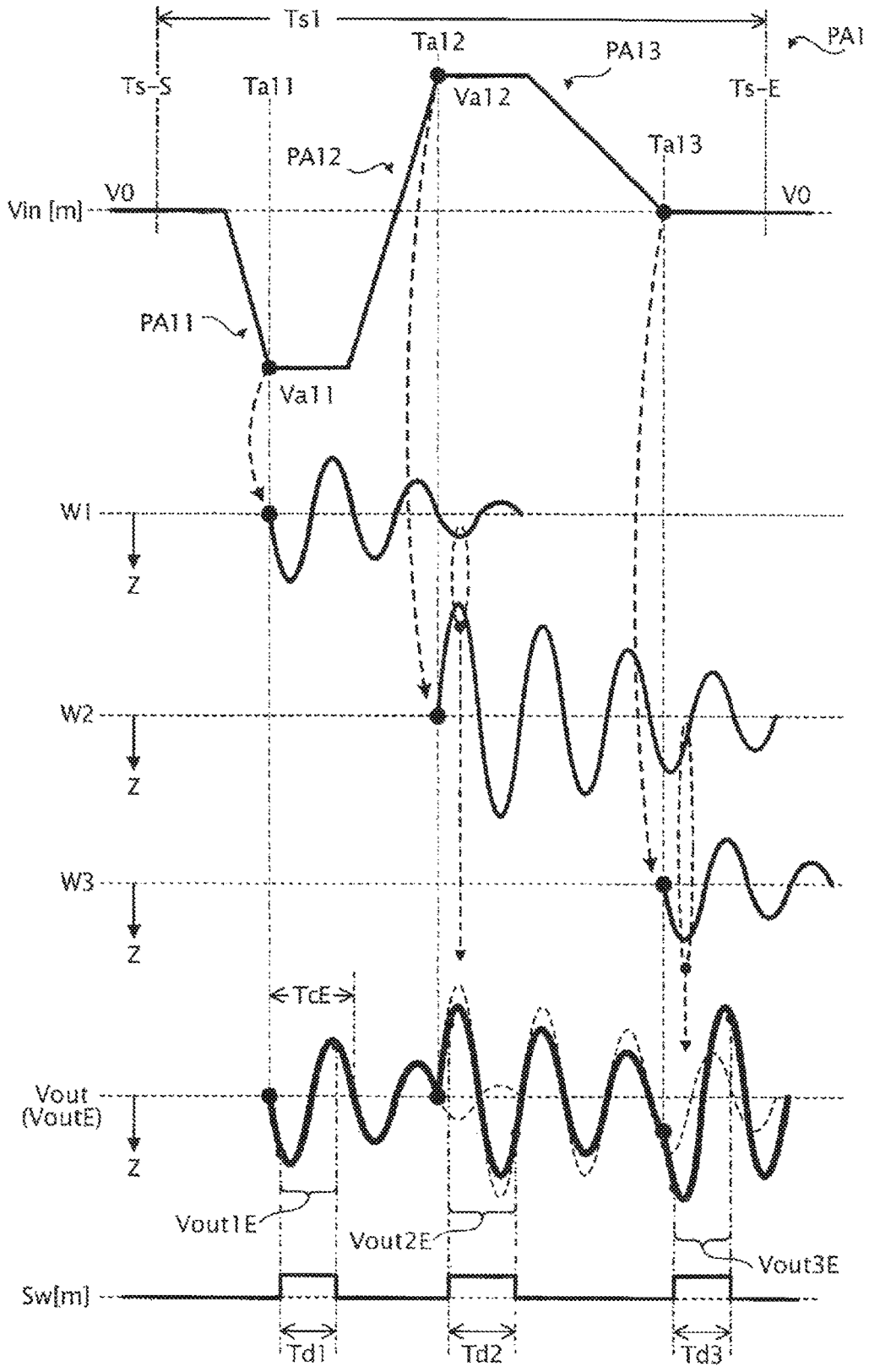
FIG. 21 illustrates residual vibrations produced by an ejecting section D in an abnormal ejection state.

Note that FIGS. 20 and 21 illustrate only the residual vibrations W1, the residual vibrations W2, and the residual vibrations W3 produced by the ejecting section D[m] in the case (1) for convenience of explanation.

FIGS. 19 to 21 illustrate an example in which the waveform PA1 is designed so that the residual vibrations W1 and the residual vibrations W2 enhance each other when the ejection state of the ink from the ejecting section D is normal. For example, the waveform PA1 is designed so that the residual vibrations W1 and the residual vibrations W2 are approximately identical in phase while taking account of the Helmholtz resonance frequency of the ejecting section D. For example, the waveform PA1 is designed so that the time length from the time Ta11 to the time Ta12 is approximately identical to a value obtained by multiplying the cycle of the residual vibration signal Vout when the ejection state of the ejecting section D is normal by a factor of (ka−½) (where, Ka is a natural number that satisfies 1≤ka).

FIGS. 19 to 21 illustrate an example in which the waveform PA1 is designed so that the residual vibrations W2 and the residual vibrations W3 attenuate each other when the ejection state of the ink from the ejecting section D is normal. For example, the waveform PA1 is designed so that the phase difference between the residual vibrations W2 and the residual vibrations W3 is approximately identical to n. For example, the waveform PA1 is designed so that the time length from the time Ta12 to the time Ta13 is approximately identical to a value obtained by multiplying the cycle of the residual vibration signal Vout when the ejection state of the ejecting section D is normal by a factor of kb (where, Kb is a natural number that satisfies 1≤kb).

In the examples illustrated in FIGS. 19 to 21, the waveform PA1 is designed taking account of the cycle of the residual vibration signal Vout so that the amplitude of the residual vibration signal Vout increases at the time Ta12, and decreases at the time Ta13 when the ejection state of the ink from the ejecting section D is normal.

However, when an abnormal ejection state has occurred in the ejecting section D, the cycle (and the frequency) of the residual vibration signal Vout changes from that when the ejection state of the ejecting section D is normal. Specifically, the cycle (frequency) of the residual vibration signal Vout when the ejection state of the ejecting section D is abnormal differs from the cycle (frequency) of the residual vibration signal Vout when the ejection state of the ejecting section D is normal. For example, the cycle (frequency) of the residual vibrations W1, the cycle (frequency) of the residual vibrations W2, and the cycle (frequency) of the residual vibrations W3 when the ejection state of the ejecting section D is abnormal respectively differ from the cycle (frequency) of the residual vibrations W1, the cycle (frequency) of the residual vibrations W2, and the cycle (frequency) of the residual vibrations W3 when the ejection state of the ejecting section D is normal (see FIGS. 19 to 21).

Note that FIG. 21 illustrates an example in which an abnormal ejection state has occurred in the ejecting section D[m], and the frequency of the residual vibrations W1, the frequency of the residual vibrations W2, and the frequency of the residual vibrations W3 change from those when the ejection state of the ejecting section D[m] is normal (see FIG. 20). Specifically, FIG. 21 illustrates an example in which the time TcE of one cycle of the residual vibrations produced by the ejecting section D[m] is shorter than the time Tc of one cycle of the residual vibrations when the ejection state of the ejecting section D[m] is normal (see FIG. 20).

Note that FIGS. 20 and 21 illustrate an example in which the residual vibrations W1 and the residual vibrations W2 enhance each other at the time Ta12 when the ejection state of the ejecting section D is normal, but cannot enhance each other at the time Ta12 when the ejection state of the ejecting section D has become abnormal. Specifically, when the ejection state of the ejecting section D is abnormal, an increase in the amplitude of the residual vibration signal Vout at the time Ta12 is smaller as compared with the case where the ejection state of the ejecting section D is normal. In the example illustrated in FIG. 21, the residual vibrations W1 and the residual vibrations W2 attenuate each other at the time Ta12, and the amplitude of the residual vibration signal Vout at the time Ta12 is smaller than the amplitude of the residual vibrations W2 at the time Ta12.

Note that the residual vibration signal Vout when the ejection state of the ejecting section D is abnormal may be referred to as "residual vibration signal VoutE".

FIGS. 20 and 21 illustrate an example in which the residual vibrations W2 and the residual vibrations W3 attenuate each other at the time Ta13 when the ejection state of the ejecting section D is normal, but cannot attenuate each other at the time Ta13 when the ejection state of the ejecting section D has become abnormal. Specifically, when the ejection state of the ejecting section D is abnormal, a decrease in the amplitude of the residual vibration signal Vout at the time Ta13 is smaller as compared with the case where the ejection state of the ejecting section D is normal. In the example illustrated in FIG. 21, the residual vibrations W2 and the residual vibrations W3 enhance each other at the time Ta13, and the amplitude of the residual vibration signal VoutE at the time Ta13 is larger than the amplitude of the residual vibrations W2 at the time Ta13.

As illustrated in FIGS. 20 and 21, the cycle and the frequency of the residual vibration signal Vout differ between the case where the ejection state of the ejecting section D is abnormal and the case where the ejection state of the ejecting section D is normal, and it is likely that the signal level and the phase of the residual vibration signal Vout at each time also differ between the case where the ejection state of the ejecting section D is abnormal and the case where the ejection state of the ejecting section D is normal. The characteristics (e.g., cycle, signal level, and phase) of the waveform represented by the shaped waveform signal Vd are determined corresponding to the characteristics (e.g., cycle, signal level, and phase) of the waveform represented by the residual vibration signal Vout. Therefore, it is likely that the characteristics of the waveform represented by the shaped waveform signal Vd when the ejection state of the ejecting section D is abnormal differs from the characteristics of the waveform represented by the shaped waveform signal Vd when the ejection state of the ejecting section D is normal. Therefore, the ejection state of the ejecting section D can be determined based on the characteristics of the waveform represented by the shaped waveform signal Vd.

In one embodiment of the invention, the characteristic information generation section 41 generates the characteristic information Info that represents the signal level-phase characteristics of the waveform represented by the shaped waveform signal Vd. Specifically, the characteristic information generation section 41 generates the characteristic information Info that includes information about the change in signal level and the phase of the shaped waveform signal Vd1, information about the change in signal level and the phase of the shaped waveform signal Vd2, and information about the change in signal level and the phase of the shaped waveform signal Vd3.

The determination information generation section 42 determines whether or not the characteristics of the waveform represented by the shaped waveform signal Vd are included within the possible range of the characteristics of the waveform represented by the shaped waveform signal Vd when the ejection state of the ejecting section D is normal based on the characteristic information Info, and generates the determination information RS that represents the determination result. This makes it possible to determine whether or not the waveform of the residual vibration signal Vout detected by the detection unit 8 is considered to be the waveform of the residual vibration signal Vout when the ejection state of the ejecting section D is normal, and determine the ejection state of the ink from the ejecting section D.

The characteristic information generation section 41 compares the signal level of the shaped waveform signal Vd with the threshold potentials represented by the threshold potential signal SVth, and outputs the measured times obtained as a result of the comparison as the characteristic information Info. The determination information generation section 42 compares the measured times included in the characteristic information Info with the determination references represented by the reference information STth, and generates the determination information RS based on the comparison results.

Note that the threshold potentials represented by the threshold potential signal SVth, the measured times represented by the characteristic information Info, and the determination references represented by the reference information STth may be appropriately determined based on the shape of the determination drive waveform (waveform PA1), the characteristics of the residual vibrations produced by the ejecting section D driven using the determination drive waveform, and the like. Specifically, the details of the threshold potential signal SVth, the characteristic information Info, and the reference information STth are determined so that it is possible to determine whether the waveform of the residual vibrations produced by the ejecting section D has a shape when the ejection state of the ejecting section D is normal, or a shape when the ejection state of the ejecting section D is abnormal. The details of the threshold potential signal SVth, the characteristic information Info, and the reference information STth are determined so that it is possible to determine whether the waveform of the residual vibrations produced by the ejecting section D when the ejection state of the ejecting section D is abnormal has a shape when air bubbles have been formed in the cavity 320, or a shape when the viscosity of the ink contained in the cavity 320 has increased, or a shape when a foreign substance has adhered to an area around the nozzle N.

An example of the threshold potentials represented by the threshold potential signal SVth, an example of the measured times represented by the characteristic information Info, and an example of the determination references represented by the reference information STth are described below with reference to FIGS. 22A to 22C.

Figure 22A:
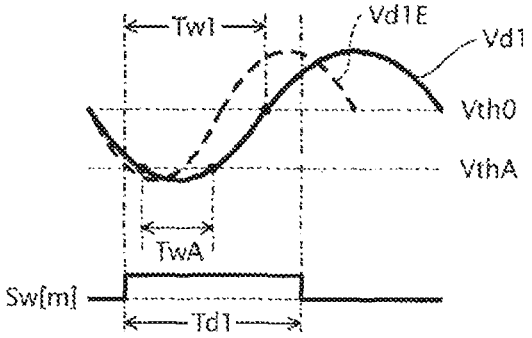
FIG. 22A illustrates the generation of characteristic information Info.
Figure 22B:
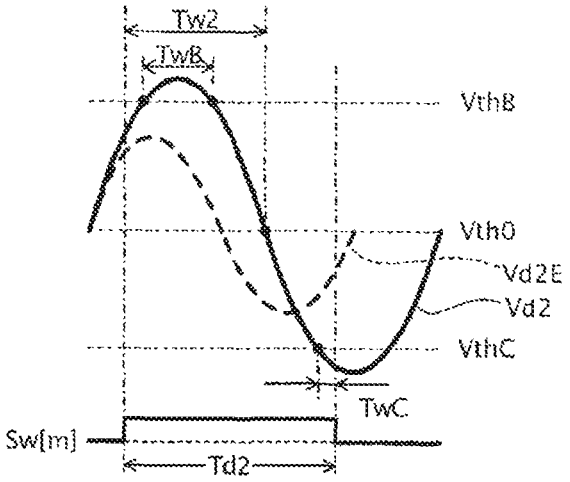
FIG. 22B illustrates the generation of characteristic information Info.
Figure 22C:
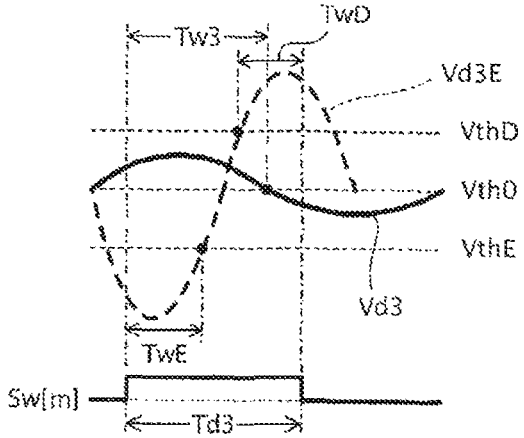
FIG. 22C illustrates the generation of characteristic information Info.

FIGS. 22A to 22C illustrate an example of the threshold potential signal SVth, the characteristic information Info, and the reference information STth. Note that FIGS. 22A to 22C illustrate an example in which the waveform PA1 is the waveform PA1 illustrated in FIG. 19, the waveform of the residual vibrations produced by the target ejecting section Dtg in a normal ejection state is the waveform of the residual vibration signal Vout illustrated in FIG. 20, and the waveform of the residual vibrations produced by the target ejecting section Dtg in an abnormal ejection state is the waveform of the residual vibration signal VoutE illustrated in FIG. 21.

In the examples illustrated in FIGS. 22A to 22C, the threshold potentials represented by the threshold potential signal SVth include threshold potentials Vth0, VthA, VthB, VthC, VthD, and VthE, and the characteristic information Info represents measured times Tw1, Tw2, Tw3, TwA, TwB, TwC, TwD, and TwE. The shaped waveform signal Vd1 generated based on the residual vibration signal Vout1 when the ejection state of the target ejecting section Dtg is abnormal is referred to as "shaped waveform signal Vd1E", the shaped waveform signal Vd2 generated based on the residual vibration signal Vout2 when the ejection state of the target ejecting section Dtg is abnormal is referred to as "shaped waveform signal Vd2E", and the shaped waveform signal Vd3 generated based on the residual vibration signal Vout3 when the ejection state of the target ejecting section Dtg is abnormal is referred to as "shaped waveform signal Vd3E".

When the waveform PA1 is the waveform illustrated in FIG. 19, and the waveform of the residual vibrations is the waveform illustrated in FIG. 20 or 21, the characteristic information generation section 41 compares the potential represented by the shaped waveform signal Vd1 with the threshold potentials Vth0 and VthA (see FIG. 22A). The characteristic information generation section 41 thus measures the measured time Tw1 that represents the time length in which the potential of the shaped waveform signal Vd1 is equal to or lower than the threshold potential Vth0 in the detection period Td1, and the measured time TwA that represents the time length in which the potential of the shaped waveform signal Vd1 is equal to or lower than the threshold potential VthA in the detection period Td1. Note that the threshold potential Vth0 is a potential at the amplitude center level of the shaped waveform signal Vd. The threshold potential VthA is a potential that is lower than the threshold potential Vth0.

The characteristic information generation section 41 compares the potential represented by the shaped waveform signal Vd2 with the threshold potentials Vth0, VthB, and VthC (see FIG. 22B). The characteristic information generation section 41 thus measures the measured time Tw2 that represents the time length in which the potential of the shaped waveform signal Vd2 is equal to or higher than the threshold potential Vth0 in the detection period Td2, the measured time TwB that represents the time length in which the potential of the shaped waveform signal Vd2 is equal to or higher than the threshold potential VthB in the detection period Td2, and the measured time TwC that represents the time length in which the potential of the shaped waveform signal Vd2 is equal to or lower than the threshold potential VthC in the detection period Td2. Note that the threshold potential VthB is a potential that is higher than the threshold potential Vth0. The threshold potential VthC is a potential that is lower than the threshold potential Vth0.

The characteristic information generation section 41 compares the potential represented by the shaped waveform signal Vd3 with the threshold potentials Vth0, VthD, and VthE (see FIG. 22C). The characteristic information generation section 41 thus measures the measured time Tw3 that represents the time length in which the potential of the shaped waveform signal Vd3 is equal to or higher than the threshold potential Vth0 in the detection period Td3, the measured time TwD that represents the time length in which the potential of the shaped waveform signal Vd3 is equal to or higher than the threshold potential VthD in the detection period Td3, and the measured time TwE that represents the time length in which the potential of the shaped waveform signal Vd3 is equal to or lower than the threshold potential VthE in the detection period Td3. Note that the threshold potential VthD is a potential that is higher than the threshold potential Vth0. The threshold potential VthD is set to be higher than the highest potential of the shaped waveform signal Vd3. The threshold potential VthE is a potential that is lower than the threshold potential Vth0. The threshold potential VthE is set to be lower than the lowest potential of the shaped waveform signal Vd3.

In the examples illustrated in FIGS. 22A to 22C, the measured times Tw1, Tw2, and Tw3 included in the characteristic information Info are information that represents the time length until the signal level of the shaped waveform signal Vd reaches the amplitude center (i.e., information that represents the phase characteristics of the shaped waveform signal Vd). In the examples illustrated in FIGS. 22A to 22C, the measured times TwA, TwB, TwC, TwD, and TwE included in the characteristic information Info are information that represents the time length in which the signal level of the shaped waveform signal Vd is equal to or higher than the threshold potential, or the time length in which the signal level of the shaped waveform signal Vd is equal to or lower than the threshold potential (i.e., information that represents the signal level characteristics of the shaped waveform signal Vd).

In the examples illustrated in FIGS. 19 to 22C, the determination information generation section 42 compares the measured times Tw1, Tw2, Tw3, TwA, TwB, TwC, TwD, and TwE included in the characteristic information Info measured by the characteristic information generation section 41, with reference values Tw1L, Tw1H, Tw2L, Tw2H, Tw3L, Tw3H, TwAL, TwAH, TwBL, TwBH, TwCL, TwCH, TwD0, and TwE0 represented by the reference information STth output from the control section 6 to determine whether or not the waveform represented by the shaped waveform signal Vd is the waveform based on the residual vibration signal Vout detected when the ejection state of the target ejecting section Dtg is normal.

Note that the reference values represented by the reference information STth are threshold values determined in advance based on the measured times represented by the characteristic information Info measured when the ejection state of the target ejecting section Dtg is normal, and the measured times represented by the characteristic information Info measured when the ejection state of the target ejecting section Dtg is abnormal. Specifically, the reference values represented by the reference information STth are threshold values that represent the boundary with respect to the measured times represented by the characteristic information Info that represents the characteristics of the shaped waveform signal Vd based on the residual vibration signal Vout, and the measured times represented by the characteristic information Info that represents the characteristics of the shaped waveform signal VdE based on the residual vibration signal VoutE.

In the examples illustrated in FIGS. 19 to 22C, the determination information generation section 42 determines that an error between the waveform of the shaped waveform signal Vd based on the residual vibration signal Vout detected from the target ejecting section Dtg, and the waveform of the shaped waveform signal Vd based on the residual vibration signal Vout detected from the ejecting section D in a normal ejection state, is within a predetermined range, and these waveforms have an approximately identical shape, when the measured times included in the characteristic information Info satisfy all of the following expressions (1) to (8). Specifically, the determination information generation section 42 determines that the ejection state of the target ejecting section Dtg is normal when the measured times included in the characteristic information Info satisfy all of the expressions (1) to (8), and generates the determination information RS[m] that represents the determination result. The determination information generation section 42 determines that the ejection state of the ejecting section D is abnormal when the measured times included in the characteristic information Info do not satisfy at least one of the expressions (1) to (8), and generates the determination information RS[m] that represents the determination result.

$$Tw1L \leq Tw1 \leq Tw1H \quad (1)$$

$$Tw2L \leq Tw2 \leq Tw2H \quad (2)$$

$$Tw3L \leq Tw3 \leq Tw3H \quad (3)$$

$$TwAL \leq TwA \leq TwAH \quad (4)$$

$$TwBL \leq TwB \leq TwBH \quad (5)$$

$$TwCL \leq TwC \leq TwCH \quad (6)$$

$$TwD = TwD0 \text{ (where, } TwD0 = 0) \quad (7)$$

$$TwE = TwE0 \text{ (where, } TwE0 = 0) \quad (8)$$

As described above, the control section 6 controls the drive signal supply section 50 during the ejection state determination process so that the drive signal supply section 50 supplies the drive signal Vin[m] having the waveform PA1 (i.e., determination drive waveform) to the ejecting section D[m] designated as the target ejecting section Dtg. The control section 6 controls the operation of the determination unit 4 so that the determination unit 4 generates the characteristic information Info based on the shaped waveform signal Vd1 that represents the residual vibrations produced by the ejecting section D[m] in the detection period Td1, the shaped waveform signal Vd2 that represents the residual vibrations produced by the ejecting section D[m] in the detection period Td2, and the shaped waveform signal Vd3 that represents the residual vibrations produced by the ejecting section D[m] in the detection period Td3. The control section 6 controls the operation of the determination unit 4 so that the determination unit 4 determines the ejection state of the ink from the ejecting section D[m] based on the characteristic information Info, and generates the determination information RS[m] that represents the determination result.

6. Conclusion

According to the embodiments of the invention, the ejection state of the ink from the ejecting section D is determined based on the information about the phase and the signal level of the residual vibrations produced by the ejecting section D (see above). Specifically, the ejection state of the ejecting section D is determined without measuring the time corresponding to one cycle of the residual vibrations produced by the ejecting section D. Therefore, even when each of the detection period Td1, the detection period Td2, and the detection period Td3 included in the detection period Td is shorter than the cycle of the residual vibrations produced by the ejecting section D, it is possible to determine the characteristics of the residual vibrations produced by the ejecting section D, and determine the ejection state of the ejecting section D based on the characteristics of the residual vibrations thus determined.

A known ejection state determination process determines the ejection state of the ejecting section D based on the time corresponding to one cycle of the residual vibrations produced by the ejecting section D (hereinafter referred to as "comparative example"). According to the comparative example, one detection period that has a time length longer than one cycle of the residual vibrations and is used to detect the residual vibrations corresponding to at least one cycle is normally provided to the determination drive waveform. The signal level of the determination drive waveform is normally maintained at a constant level in the detection period in order to accurately detect the residual vibrations. Specifically, the determination drive waveform according to the comparative example is normally provided with a detection waveform of which the signal level is maintained at an approximately constant level corresponding to one detection period that has a time length longer than the cycle of the residual vibrations.

According to the comparative example, when it is desired to use a common waveform as the print waveform (e.g., ejection waveform) used for the printing process and the determination drive waveform used for the ejection state determination process, it is necessary to provide the print waveform with the detection waveform that has a time length longer than one cycle of the residual vibrations. This makes it difficult to reduce the cycle of the print waveform, whereby it may be difficult to implement a high-speed printing process. Therefore, it is necessary to separately provide the determination drive waveform and the print waveform, and perform the printing process and the ejection state determination process at different timings in order to implement a high-speed printing process. As a result, convenience to the user of the inkjet printer 1 may be impaired.

According to the embodiments of the invention, the detection period Td1, the detection period Td2, and the detection period Td3 that are shorter than the cycle of the residual vibrations are provided to the determination drive waveform in a dispersed state instead of providing one detection period that is longer than the cycle of the residual vibrations.

Therefore, it is possible to reduce the degree of limitations when the detection waveform for detecting the residual vibrations is provided to the determination drive waveform, and improve the degree of freedom with regard to the waveform design as compared with the comparative example. Specifically, it is possible to reduce the cycle of the determination drive waveform as compared with the comparative example. It is also possible to easily reduce the cycle of the determination drive waveform (and the print waveform) even when a common waveform is used as the determination drive waveform and the print waveform. This makes it possible to perform the ejection state determination process during the printing process when it is desired to implement a high-speed printing process. This makes it possible to promptly deal with a situation in which an abnormal ejection state has occurred during the printing process, and prevent a situation in which the print quality suddenly deteriorates during the printing process.

According to the embodiments of the invention, since the information about the characteristics of the waveform of the residual vibrations is acquired in the detection period Td1, the detection period Td2, and the detection period Td3, a larger amount of information can be acquired as compared with the case of acquiring the information about the characteristics of the waveform of the residual vibrations in only one detection period among the detection period Td1, the detection period Td2, and the detection period Td3.

This makes it possible to improve the determination accuracy as to whether or not the waveform of the residual signal falls under the waveform when the ejection state is normal based on the characteristic information Info about the characteristics of the waveform of the residual vibrations (i.e., the determination accuracy as to the ejection state of the ejecting section D based on the characteristic information Info).

Note that the waveform PA1 (i.e., determination drive waveform) according to the embodiments of the invention is designed so that the difference between the potential Va13 and the potential Va11 is larger than the difference between the potential Va12 and the potential Va13. Therefore, it is possible to reduce the possibility that the residual vibrations produced by the target ejecting section Dtg remains even after the time Ts-E as compared with the case where the difference between the potential Va12 and the potential Va13 is larger than the difference between the potential Va13 and the potential Va11. This makes it possible to reduce the possibility that the ejection state determination process performed in one unit period Tu affects (as noise) the printing process and the ejection state determination process performed in the subsequent unit period Tu.

As described above, the embodiments of the invention can increase the amount of information about the characteristics of the residual vibrations that can be acquired from the detection waveform while preventing a situation in which the degree of freedom with regard to the design of the determination drive waveform decreases as a result of providing the detection waveform.

B. Modifications

The embodiments of the invention described above may be modified in various ways. Examples of specific modifications are described below. Two or more modifications arbitrarily selected from the specific modifications described below may be appropriately combined as long as a contradiction does not occur. The elements described below in connection with the specific modifications that are identical in either or both of effects and functions to those described in connection with the above embodiments are indicated by the same reference signs as those used in connection with the above embodiments, and detailed description thereof is appropriately omitted.

First Modification

Although the above embodiments have been described taking an example in which the detection unit 8 detects the residual vibration signal Vout1 in the detection period Td1, detects the residual vibration signal Vout2 in the detection period Td2, and detects the residual vibration signal Vout3 in the detection period Td3, the invention is not limited thereto. It suffices that the detection unit 8 at least detect the residual vibration signal Vout3 in the detection period Td3.

For example, the detection unit 8 may detect only the residual vibration signal Vout3 without detecting the residual vibration signal Vout1 and the residual vibration signal Vout2. In this case, the connection circuit Ux[m] that corresponds to the ejecting section D[m] designated as the target ejecting section Dtg in one unit period Tu is set to the second connection state in the detection period Td3 within the one unit period Tu, and is set to the first connection state in a period within the one unit period Tu other than the detection period Td3. The determination unit 4 determines the ejection state of the target ejecting section Dtg using the shaped waveform signal Vd3 that has been generated by the detection unit 8 based on the residual vibration signal Vout3, and generates the determination information RS that represents the determination result.

The detection unit 8 may detect the residual vibration signal Vout3 and one of the residual vibration signal Vout1 and the residual vibration signal Vout2.

Second Modification

Although the above embodiments and modifications have been described taking an example in which the waveform PA11 that changes from the reference potential V0 to the potential Va11 (i.e., first potential) is used as the first waveform, the invention is not limited thereto. It suffices that the first waveform be a waveform that changes from a potential that differs from the first potential to the first potential. The second waveform is not limited to a waveform that changes from the first potential to the second potential. It suffices that the second waveform be a waveform that changes from a potential that differs from the second potential to the second potential. The third waveform is not limited to a waveform that changes from the second potential to the third potential. It suffices that the third waveform be a waveform that changes from a potential that differs from the third potential to the third potential.

Third Modification

Although the above embodiments and modifications have been described taking an example in which the waveform PA1 uses the potential Va1, the potential Va12, and the potential Va13 (reference potential V0) as the holding potential at which the signal is held for a time equal to or longer than a given time, the invention is not limited thereto. The waveform PA1 may also use a potential other than the potential Va11, the potential Va12, and the potential Va13 as the holding potential.

Figure 23:
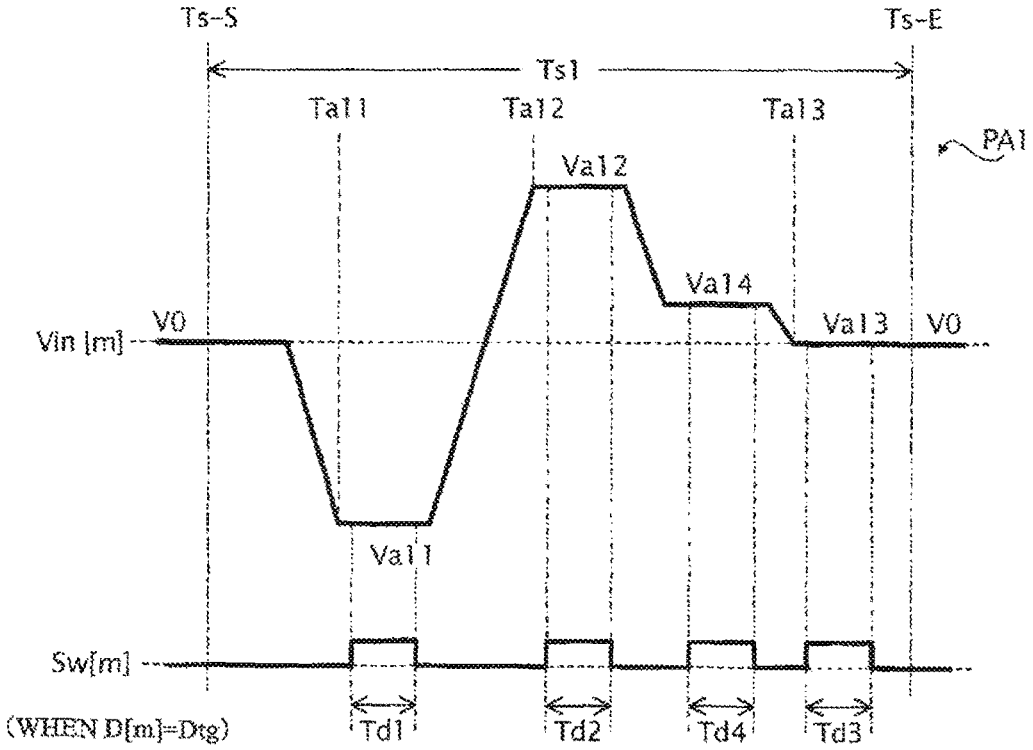
FIG. 23 is a timing chart illustrating a waveform PA1 according to a third modification.

For example, the waveform PA1 may also use a potential Va14 as the holding potential (see FIG. 23). In the example illustrated in FIG. 23, the potential Va14 is a potential between the potential Va12 and the potential Va13, the waveform PA1 is designed so that the signal is held at the potential Va14 in a period between the end of the detection period Td2 and the start of the detection period Td3. When employing the example illustrated in FIG. 23, the detection unit 8 may detect the residual vibrations produced by the target ejecting section Dtg in a detection period Td4 in which the signal is held at the potential Va14, the detection period Td4 being part or the entirety of the period in which the signal is held at the potential Va14. In this case, the detection unit 8 generates a shaped waveform signal Vd4 based on a residual vibration signal Vout4 that represents the residual vibration detection result in the detection period Td4. The determination unit 4 generates the determination information RS based on the shaped waveform signals Vd1 to Vd4.

Fourth Modification

Although the above embodiments and modifications have been described taking an example in which the potential Va11 that is lower than the reference potential V0 is used as the first potential, the potential Va12 that is higher than the reference potential V0 is used as the second potential, and the potential Va13 that is equal to the reference potential V0 is used as the third potential, the relationship between the first potential, the second potential, and the third potential is not limited thereto.

It suffices that the first potential be set so that the volume of the cavity 320 of the ejecting section D when the first potential is supplied to the ejecting section D as the drive signal Vin is larger than the volume of the cavity 320 of the ejecting section D when the reference potential V0 is supplied to the ejecting section D as the drive signal Vin.

It suffices that the second potential be set so that the volume of the cavity 320 of the ejecting section D when the second potential is supplied to the ejecting section D as the drive signal Vin is smaller than the volume of the cavity 320 of the ejecting section D when the first potential is supplied to the ejecting section D as the drive signal Vin.

It suffices that the third potential be set so that the volume of the cavity 320 of the ejecting section D when the third potential is supplied to the ejecting section D as the drive signal Vin is larger than the volume of the cavity 320 of the ejecting section D when the second potential is supplied to the ejecting section D as the drive signal Vin.

Fifth Modification

Although the above embodiments and modifications have been described taking an example in which each of the detection period Td1, the detection period Td2, and the detection period Td3 is shorter than the cycle of the residual vibrations produced when the ejection state of the ejecting section D is normal, each of the detection period Td1, the detection period Td2, and the detection period Td3 may be longer than the cycle of the residual vibrations.

Sixth Modification

Although the above embodiments and modifications have been described taking an example in which the ejection waveform PA1 included in the print waveform is used as the determination drive waveform, the invention is not limited thereto. A waveform included in the print waveform other than the waveform PA1 may be used as the determination drive waveform. For example, the ejection waveform PA2 may be used as the determination drive waveform, or the non-ejection waveform such as the micro-vibration waveform PB may be used as the determination drive waveform.

A plurality of print waveforms may be used as the determination drive waveform. For example, both the ejection waveform PA1 and the ejection waveform PA2 may be used as the determination drive waveform. In this case, six detection periods can be provided within one unit period Tu by providing three detection periods to the waveform PA1, and providing three detection periods to the waveform PA2, for example. This makes it possible to further improve the ejection state determination accuracy.

Although the above embodiments and modifications have been described taking an example in which the print waveform is used as the determination drive waveform, a waveform other than the print waveform may be used as the determination drive waveform. In this case, the ejection state determination process may be performed in the unit period Tu in which the printing process is not performed.

Seventh Modification

Although the above embodiments and modifications have been described taking an example in which the characteristic information Info is information about the signal level and the phase of the waveform represented by the shaped waveform signal Vd, the invention is not limited thereto. The characteristic information Info may include information about at least one of the signal level, the phase, and the cycle of the waveform represented by the shaped waveform signal Vd.

When the characteristic information Info includes information about the cycle of the waveform represented by the shaped waveform signal Vd, it is preferable that one or more detection periods among the detection period Td1, the detection period Td2, and the detection period Td3 be longer than the cycle of the shaped waveform signal Vd (see the third modification).

Eighth Modification

Although the above embodiments have been described taking an example in which the inkjet printer 1 includes four recording heads 3, four detection units 8, and four determination units 4 (i.e., the ratio of the number of recording heads 3, the number of detection units 8, and the number of determination units 4 is 1:1:1), the invention is not limited thereto. The ratio of the number of recording heads 3, the number of detection units 8, and the number of determination units 4 may be other than 1:1:1. For example, the inkjet printer 1 may include four recording heads 3, five or more detection units 8, and five or more determination units 4, or may include four recording heads 3, three or less detection units 8, and three or less determination units 4.

Although the above embodiments and modifications have been described taking an example in which the inkjet printer 1 includes four head units 10 that correspond to four ink cartridges 31 on a one-to-one basis, it suffices that the inkjet printer 1 include at least one head unit 10, and the number of ink cartridges 31 and the number of head units 10 may differ from each other.

Ninth Modification

Although the above embodiments have been described taking an example in which the inkjet printer 1 is a line printer in which the nozzle rows Ln are provided so that the range YNL includes the range YP, the invention is not limited thereto. The inkjet printer 1 may be a serial printer in which the recording head 3 moves forward and backward in the Y-axis direction to implement the printing process.

Tenth Modification

Although the above embodiments and modifications have been described taking an example in which the inkjet printer 1 can eject CMYK inks, the invention is not limited thereto. It suffices that the inkjet printer 1 can eject an ink corresponding to at least one color, and the color of the ink may be a color other than CMYK.

Although the above embodiments and modifications have been described taking an example in which the inkjet printer 1 includes four nozzle rows Ln, it suffices that the inkjet printer 1 include at least one nozzle row Ln.

Eleventh Modification

Although the above embodiments and modifications have been described taking an example in which the drive waveform signal Com includes the drive waveform signal Com-A and the drive waveform signal Com-B, the invention is not limited thereto. It suffices that the drive waveform signal Com include one or more signals. Specifically, the drive waveform signal Com may include only one signal (e.g., drive waveform signal Corn-A), or may include three or more signals (e.g., drive waveform signals Corn-A, Com-B, and Com-C). In this case, the determination drive waveform may be provided to an arbitrary signal among the drive waveform signals Corn-A, Com-B, and Com-C.

Although the above embodiments and modifications have been described taking an example in which the unit period Tu includes the control period Ts1 and the control period Ts2, the invention is not limited thereto. The unit period Tu may include only one control period Ts, or may include three or more control periods Ts. In this case, the determination drive waveform may be provided in an arbitrary control period Ts.

Although the above embodiments and modifications have been described taking an example in which the print signal SI[m] is a 2-bit signal, the number of bits of the print signal SI[m] may be appropriately determined taking account of the desired grayscale, the number of control periods Ts included in the unit period Tu, the number of signals included in the drive waveform signal Com, and the like.

Twelfth Modification

Although the above embodiments and modifications have been described taking an example in which the determination information generation section 42 is implemented by an electronic circuit, the determination information generation section 42 may be implemented by a functional block that is implemented by causing the CPU included in the control section 6 to operate according to the control program.

Likewise, the characteristic information generation section 41 may be implemented by a functional block that is implemented by causing the CPU included in the control section 6 to operate according to the control program. In this case, the detection unit 8 may include an AD conversion circuit, and output the shaped waveform signal Vd as a digital signal.

The entire disclosure of Japanese Patent Application No. 2015-169924, filed on Aug. 31, 2015 is expressly incorporated by reference herein.

The invention claimed is:

1. A liquid ejecting device comprising:

an ejecting section that comprises a piezoelectric element that is displaced corresponding to a change in potential of a drive signal, a pressure chamber that changes in internal volume corresponding to the displacement of the piezoelectric element, and a nozzle that communicates with the pressure chamber, and can eject a liquid contained in the pressure chamber corresponding to a change in the internal volume of the pressure chamber; and a detection section that can detect residual vibrations produced by the ejecting section after the piezoelectric element has been displaced, the detection section detecting the residual vibrations produced by the ejecting section in either or both of a first period and a second period and in a third period when the drive signal having a drive waveform is supplied to the piezoelectric element, the drive waveform being set to a first potential in the first period, set to a second potential in the second period that follows the first period, and set to a third potential in the third period that follows the second period, the internal volume of the pressure chamber in the second period being smaller than the internal volume of the pressure chamber in the first period, and the internal volume of the pressure chamber in the third period being larger than the internal volume of the pressure chamber in the second period.

2. The liquid ejecting device as defined in claim 1, the drive waveform being designed so that a potential at a first time that precedes the first period is the third potential, and a potential at a second time that follows the third period is the third potential.

3. The liquid ejecting device as defined in claim 2, the drive waveform being designed so that a difference between the third potential and the first potential is larger than a difference between the second potential and the third potential.

4. The liquid ejecting device as defined in claim 1, at least one period among the first period, the second period, and the third period being shorter than a cycle of the residual vibrations produced by the ejecting section when an ejection state of the liquid from the ejecting section is normal.

5. The liquid ejecting device as defined in claim 1, further comprising:

a determination section that determines an ejection state of the liquid from the ejecting section corresponding to a detection result of the detection section.

6. The liquid ejecting device as defined in claim 1, the ejecting section ejecting the liquid contained in the pressure chamber through the nozzle in the second period.

7. A head unit comprising:

an ejecting section that comprises a piezoelectric element that is displaced corresponding to a change in potential of a drive signal, a pressure chamber that changes in internal volume corresponding to the displacement of the piezoelectric element, and a nozzle that communicates with the pressure chamber, and can eject a liquid contained in the pressure chamber corresponding to a change in the internal volume of the pressure chamber; and a detection section that can detect residual vibrations produced by the ejecting section after the piezoelectric element has been displaced, the detection section detecting the residual vibrations produced by the ejecting section in either or both of a first period and a second period and in a third period when the drive signal having a drive waveform is supplied to the piezoelectric element, the drive waveform being set to a first potential in the first period, set to a second potential in the second period that follows the first period, and set to a third potential in the third period that follows the second period, the internal volume of the pressure chamber in the second period being smaller than the internal volume of the pressure chamber in the first period, and the internal volume of the pressure chamber in the third period being larger than the internal volume of the pressure chamber in the second period.

8. A method for controlling a liquid ejecting device that comprises an ejecting section that comprises:

a piezoelectric element that is displaced corresponding to a change in potential of a drive signal;

a pressure chamber that changes in internal volume corresponding to the displacement of the piezoelectric element; and a nozzle that communicates with the pressure chamber, and can eject a liquid contained in the pressure chamber corresponding to a change in the internal volume of the pressure chamber, the method comprising:

supplying the drive signal having a drive waveform to the piezoelectric element, the drive waveform being set to a first potential in a first period, set to a second potential in a second period that follows the first period, and set to a third potential in a third period that follows the second period; and detecting residual vibrations produced by the ejecting section in either or both of the first period and the second period, detecting residual vibrations produced by the ejecting section in the third period, the internal volume of the pressure chamber in the second period being smaller than the internal volume of the pressure chamber in the first period, and the internal volume of the pressure chamber in the third period being larger than the internal volume of the pressure chamber in the second period.

* * * * *